US010012940B2

(12) United States Patent
Miura et al.

(10) Patent No.: US 10,012,940 B2
(45) Date of Patent: Jul. 3, 2018

(54) IMAGE FORMATION APPARATUS WITH CURRENT MEASURING FOR MEDIUM WIDTH INFORMATION

(71) Applicant: Oki Data Corporation, Tokyo (JP)

(72) Inventors: Hiroshi Miura, Tokyo (JP); Tetsuya Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/435,028

(22) Filed: Feb. 16, 2017

(65) Prior Publication Data

US 2017/0277097 A1 Sep. 28, 2017

(30) Foreign Application Priority Data

Mar. 24, 2016 (JP) ..... 2016-059413

(51) Int. Cl.
*G03G 15/16* (2006.01)
*G03G 15/00* (2006.01)

(52) U.S. Cl.
CPC ..... *G03G 15/5062* (2013.01); *G03G 15/1665* (2013.01)

(58) Field of Classification Search
USPC ..... 399/38, 45, 66
See application file for complete search history.

(56) References Cited

U.S. PATENT DOCUMENTS 9,046,829 B2 * 6/2015 Miura ..... G03G 15/1675
9,217,974 B2 * 12/2015 Shida ..... G03G 15/0131
2003/0118359 A1 * 6/2003 Ogiyama ..... G03G 15/167 399/45
2014/0086604 A1 3/2014 Miyazaki

FOREIGN PATENT DOCUMENTS

JP 2014-66919 A 4/2014
JP 2014-106413 A 6/2014

* cited by examiner

*Primary Examiner* — Hoan Tran
(74) *Attorney, Agent, or Firm* — Metrolexis Law Group, PLLC

(57) ABSTRACT

An image formation apparatus includes: a process device that forms a developer image; a transfer device that transfers the developer image formed by the process device onto a recording medium; a voltage applier that applies a voltage to the transfer device; and a voltage controller that acquires information on a width of the recording medium in a direction orthogonal to a medium conveyance direction, and controls the voltage applied by the voltage applier to the transfer device based on the width of the recording medium.

19 Claims, 20 Drawing Sheets

| SECONDARY-TRANSFER CURRENT MEASUREMENT VOLTAGE Em [V] | |
|---|---|
| Em1 | Em2 |

62

| SECONDARY-TRANSFER CURRENT Im [μA] | |
|---|---|
| Im1 | Im2 |

63

65

| MEASUREMENT POSITION [mm] | SECONDARY-TRANSFER CURRENT Iw [μA] |
|---|---|
| 0 | Iw 0 |
| d | Iw 1 |
| 2d | Iw 2 |
| 3d | Iw 3 |
| ... | ... |
| 50d | Iw 50 |
| ... | ... |
| N×d | Iw N |

WHERE $N \times d \leq Mw$

FIG. 12

66

| MEASUREMENT POSITION [mm] | RECORDING MEDIUM WIDTH W [mm] |
|---|---|
| 0 | W0 |
| d | W1 |
| 2d | W2 |
| 3d | W3 |
| ... | ... |
| 50d | W50 |
| ... | ... |
| N×d | WN |

WHERE $N \times d \leq Mw$

FIG. 13

67

| TYPE OF RECORDING MEDIUM | SECONDARY-TRANSFER FAVORABLE CURRENT DENSITY Jb [μA/mm] | SECONDARY-TRANSFER FAVORABLE VOLTAGE Vb [V] |
|---|---|---|
| PLAIN PAPER | Jb1 | Vb1 |
| HEAVY PAPER | Jb2 | Vb2 |
| FILM PAPER | Jb3 | Vb3 |

FIG. 15

| MEASUREMENT POSITION [mm] | SECONDARY-TRANSFER VOLTAGE Vtr [V] |
|---|---|
| 0 | Vtr0 |
| d | Vtr1 |
| 2d | Vtr2 |
| 3d | Vtr3 |
| ... | ... |
| 50d | Vtr50 |
| ... | ... |
| N×d | VtrN |

68

WHERE $N \times d \leq Mw$

71

| TYPE OF RECORDING MEDIUM | SECONDARY-TRANSFER FAVORABLE CURRENT DENSITY Jb' [μA/mm] | SECONDARY-TRANSFER FAVORABLE VOLTAGE Vb' [V] |
|---|---|---|
| PLAIN PAPER | Jb1' | Vb1' |
| HEAVY PAPER | Jb2' | Vb2' |
| FILM PAPER | Jb3' | Vb3' |

IMAGE FORMATION APPARATUS WITH CURRENT MEASURING FOR MEDIUM WIDTH INFORMATION

CROSS REFERENCE TO RELATED APPLICATIONS

This application claims priority based on 35 USC § 119 from prior Japanese Patent Application No. 2016-059413 filed on Mar. 24, 2016, entitled "IMAGE FORMATION APPARATUS", the entire contents of which are incorporated herein by reference.

BACKGROUND OF THE INVENTION

1. Field of the Invention

This disclosure relates to an image formation apparatus that electrophotographically forms an image on a recording medium.

2. Description of Related Art

Some electrophotographic image formation apparatuses such as color printers use an intermediate transfer method involving two transfer operations: a primary transfer to transfer a developer image formed by a process unit, which includes components such as an image carrier, onto an intermediate transfer body; and a secondary transfer to transfer the developer image on the intermediate transfer body onto a recording medium such as a print sheet (see, for example, Japanese Patent Application Publication No. 2014-106413 (FIG. 1)).

SUMMARY OF THE INVENTION

In recent years, a recording medium of a varying width in a direction orthogonal to a medium conveyance direction (an odd-shaped medium) may be used in such an image formation apparatus using the intermediate transfer method. When such an odd-shaped medium is used, it is difficult to optimally control a voltage for the secondary transfer according to the varying width of the medium. It is difficult also for an image formation apparatus using a direct transfer method to optimally control a transfer voltage according to the varying width of the medium.

An object of one aspect of the invention is to provide an image formation apparatus capable of applying an appropriate transfer voltage to a recording medium even when the recording medium has a varying width in a direction orthogonal to a medium conveyance direction.

An aspect of the invention is an image formation apparatus that includes: a process device that forms a developer image; a transfer device that transfers the developer image formed by the process device onto a recording medium; a voltage applier that applies a voltage to the transfer device; and a voltage controller that acquires information on the width of the recording medium in a direction orthogonal to the medium conveyance direction, and controls the voltage applied by the voltage applier to the transfer device based on the width of the recording medium.

According to the aspect of the invention, an optimal transfer voltage can be applied to a recording medium with a varying width.

BRIEF DESCRIPTION OF THE DRAWINGS

FIG. 12 is a diagram illustrating an example of a recording medium width table stored in the memory in the first embodiment.

FIG. 13 is a diagram illustrating an example of a secondary-transfer favorable current density and voltage table stored in the memory in the first embodiment.

FIG. 15 is a schematic diagram illustrating an example of a secondary-transfer voltage table stored in the memory in the first embodiment.

DETAILED DESCRIPTION OF EMBODIMENTS

Figure 1:
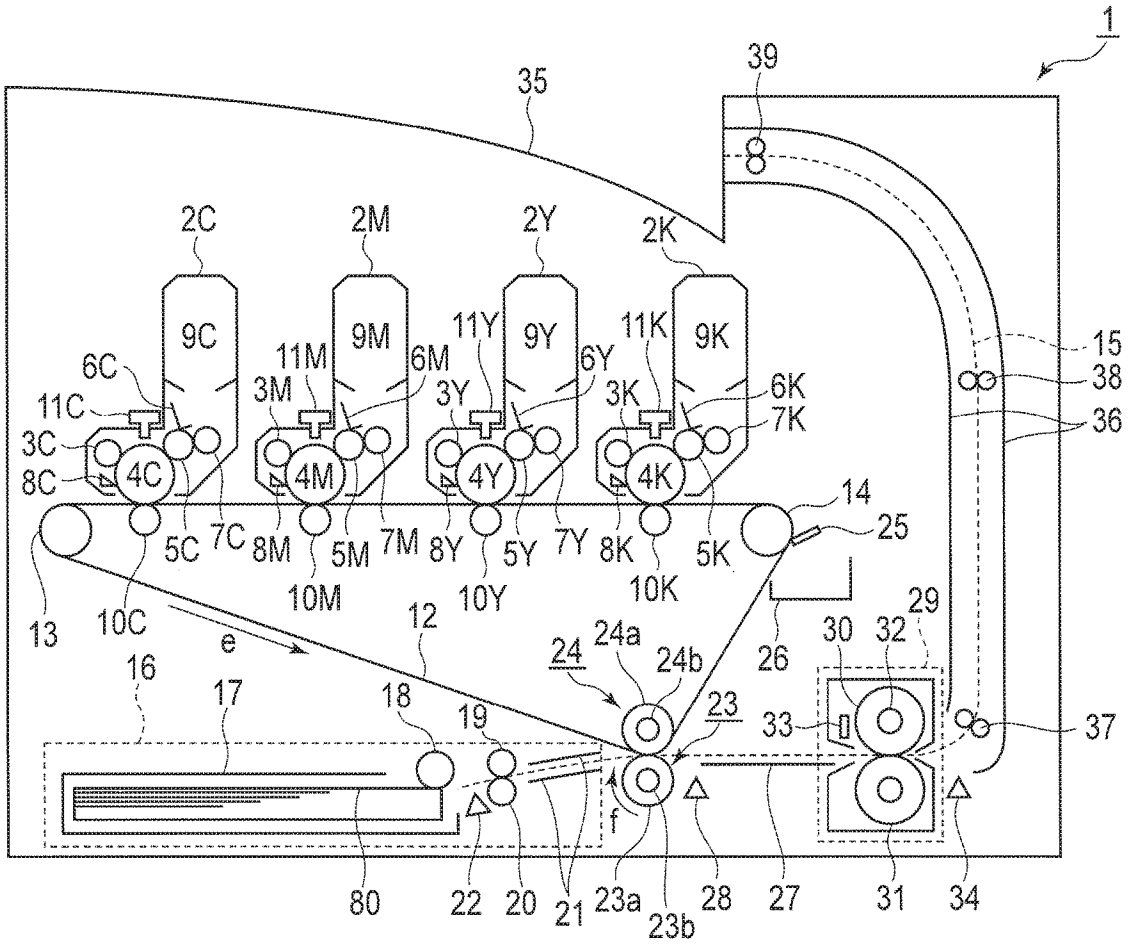
FIG. 1 is a diagram illustrating the configuration of an image formation apparatus of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

Configuration of the Image Formation Apparatus

FIG. 1 is a diagram illustrating the configuration of image formation apparatus 1 of a first embodiment. Image formation apparatus 1 is, for example, a color printer, and electrophotographically prints toner images (developer images) on recording medium 80 based on print data sent from a host computer (an external device).

The image formation apparatus 1 includes process devices 2K, 2Y, 2M, and 2C as image formation devices, light emitting diode (LED) heads 11K, 11Y, 11M, and 11C as light exposure devices, intermediate transfer belt 12 as an intermediate transfer body, primary-transfer rollers 10K, 10Y, 10M, and 10C as primary-transfer devices, secondary-transfer roller 23 and secondary-transfer opposed roller 24 as a secondary-transfer device, and fixation device 29.

Process devices 2K, 2Y, 2M, and 2C form toner images in black (K), yellow (Y), magenta (M), and cyan (C), respectively, and are aligned in this order from right to left as viewed in FIG. 1 along a moving direction of intermediate transfer belt 12.

Process devices 2K, 2Y, 2M, and 2C include, respectively, photosensitive drums 4K, 4Y, 4M, and 4C as image carriers, charge rollers 3K, 3Y, 3M, and 3C as charge members, developer rollers 5K, 5Y, 5M, and 5C as developer carriers, developing blades 6K, 6Y, 6M, and 6C as developer regulation members, supply rollers 7K, 7Y, 7M, and 7C as supply members, static-elimination light sources 8K, 8Y, 8M, and 8C, and toner cartridges 9K, 9Y, 9M, and 9C as developer reservoirs.

Photosensitive drums 4K, 4Y, 4M, and 4C are each formed by a cylindrical conductive support and a photosensitive layer on a surface (the outer circumferential surface) of the support, the photosensitive layer being formed by stacking a charge generation layer and a charge transport layer. Photosensitive drums 4K, 4Y, 4M, and 4C are driven and rotated in one direction (here, clockwise in FIG. 1) by a force produced by drum motor 47 (FIG. 3).

Charge rollers 3K, 3Y, 3M, and 3C are in contact with the surfaces of photosensitive drums 4K, 4Y, 4M, and 4C and rotate by following the rotation of photosensitive drums 4K, 4Y, 4M, and 4C. Charge rollers 3K, 3Y, 3M, and 3C receive charge voltages from charge voltage generator 51 and thereby evenly charge the surfaces of photosensitive drums 4K, 4Y, 4M, and 4C.

Figure 3:
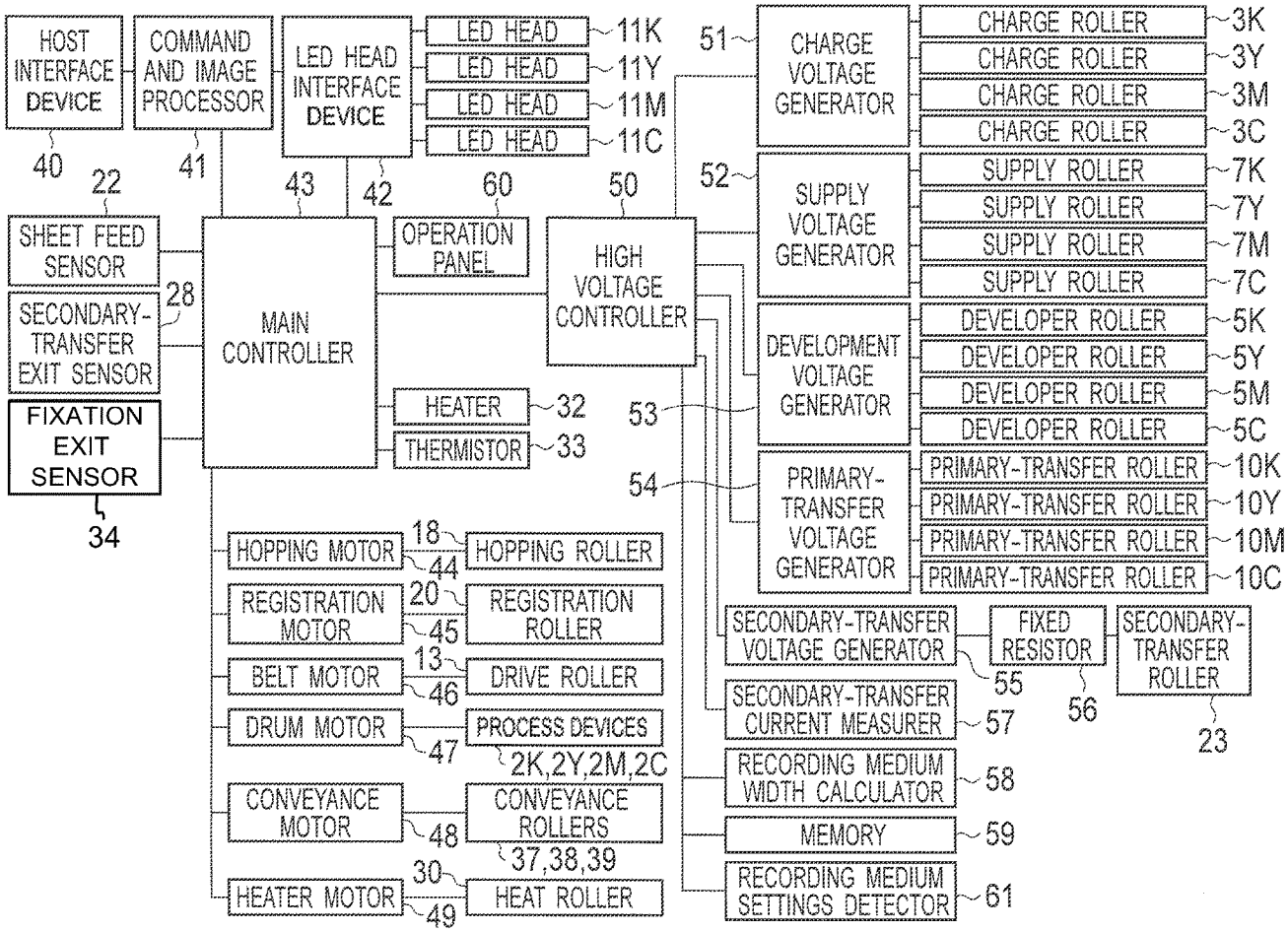
FIG. 3 is a block diagram illustrating a control system of the image formation apparatus of the first embodiment.

Developer rollers 5K, 5Y, 5M, and 5C are in contact with the surfaces of photosensitive drums 4K, 4Y, 4M, and 4C, and are rotated by indirectly receiving the force produced by the drum motor 47 (FIG. 3). Developer rollers 5K, 5Y, 5M, and 5C receive development voltages from development voltage generator 53 and thereby develop electrostatic latent images formed on the surfaces of photosensitive drums 4K, 4Y, 4M, and 4C using toners attached to the surfaces of developer rollers 5K, 5Y, 5M, and 5C.

Supply rollers 7K, 7Y, 7M, and 7C are in contact with the surfaces of developer rollers 5K, 5Y, 5M, and 5C and are rotated by indirectly receiving the force produced by drum motor 47 (FIG. 3). Supply rollers 7K, 7Y, 7M, and 7C receive supply voltages from supply voltage generator 52 and thereby supply toners to the surfaces of developer rollers 5K, 5Y, 5M, and 5C.

Developing blades 6K, 6Y, 6M, and 6C are disposed at positions to be in contact with the surfaces of developer rollers 5K, 5Y, 5M, and 5C and regulate the thicknesses of toner layers (developer layers) on the surfaces of developer rollers 5K, 5Y, 5M, and 5C.

Toner cartridges 9K, 9Y, 9M, and 9C are detachable reservoirs of toners in the respective colors, and supply the toners to supply rollers 7K, 7Y, 7M, and 7C, and developer rollers 5K, 5Y, 5M, and 5C.

Static-elimination light sources 8K, 8Y, 8M, and 8C are disposed to face the surfaces of photosensitive drums 4K, 4Y, 4M, and 4C, and eliminate static electricity from the surfaces of photosensitive drums 4K, 4Y, 4M, and 4C after the primary transfer of the toner images.

LED heads 11K, 11Y, 11M, and 11C receive image data signals for black, yellow, magenta, and cyan, respectively, through LED head interface device 42 (FIG. 3). LED heads 11K, 11Y, 11M, and 11C apply light to the surfaces of photosensitive drums 4K, 4Y, 4M, and 4C based on the image data signals thus received, and thereby form latent images (electrostatic latent images) on the surfaces of photosensitive drums 4K, 4Y, 4M, and 4C thus exposed to the light.

Intermediate transfer belt 12 is a seamless, endless belt and is made of a high-resistivity plastic film. Intermediate transfer belt 12 is stretched around drive roller 13, driven roller 14, and secondary-transfer opposed roller 24.

Drive roller 13 is driven and rotated by a force produced by belt motor 46 (FIG. 3) and moves intermediate transfer belt 12 in a direction indicated by arrow e in FIG. 1. Driven roller 14 applies a certain tension to intermediate transfer belt 12 and rotates by following the motion of intermediate transfer belt 12. Secondary-transfer opposed roller 24 constitutes the secondary-transfer device together with secondary-transfer roller 23 to be described later.

Primary-transfer rollers 10K, 10Y, 10M, and 10C serving as the primary-transfer devices are pressed against photosensitive drums 4K, 4Y, 4M, and 4C with intermediate transfer belt 12 interposed in-between. A primary-transfer nip is formed between each of primary-transfer rollers 10K, 10Y, 10M, and 10C and a corresponding one of photosensitive drums 4K, 4Y, 4M, and 4C sandwiching intermediate transfer belt 12.

Primary-transfer voltage generator 54 (FIG. 3) applies a primary-transfer voltage to primary-transfer rollers 10K, 10Y, 10M, and 10C. The primary-transfer voltage causes the toner images on the surfaces of photosensitive drums 4K, 4Y, 4M, and 4C to be transferred onto intermediate transfer belt 12.

Image formation apparatus 1 has conveyance path 15 (indicated by the dotted line in FIG. 1) along which recording medium 80 (for example, a print sheet) is conveyed.

Feeder mechanism 16 that feeds recording medium 80 to conveyance path 15 is provided in a lower part of image formation apparatus 1.

Feeder mechanism 16 includes media cassette 17 as a media container that houses recording medium 80 and hopping roller 18 that picks up and feeds recording medium 80 housed in media cassette 17. Next to hopping roller 18, registration roller 20 and pinch roller 19 are disposed, facing each other. Registration roller 20 feeds recording medium 80 toward the secondary-transfer device, and pinch roller 19 corrects the skew of recording medium 80. Sheet feed sensor 22 is disposed between hopping roller 18 and registration roller 20 to detect that recording medium 80 has been fed. Feeder mechanism 16 also includes guide 21 that guides recording medium 80 conveyed by registration roller 20 and pinch roller 19, toward the secondary-transfer device to be described later.

Downstream of feeder mechanism 16 in terms of a direction in which recording medium 80 is conveyed (hereinafter referred to as the medium conveyance direction), secondary-transfer roller 23 and secondary-transfer opposed roller 24 that constitute the secondary-transfer device are disposed.

Secondary-transfer roller 23 includes metal shaft 23*b* and elastic layer 23*a* formed on the surface of metal shaft 23*b*. Elastic layer 23*a* is made, for example, of urethane foam with electrical conductivity, having a volume resistivity of about $10^7$ Ω·cm to $10^9$ Ω·cm.

Secondary-transfer opposed roller 24 includes metal shaft 24*b* and metal roller 24*a*. Secondary-transfer roller 23 faces secondary-transfer opposed roller 24 with intermediate transfer belt 12 interposed in-between.

Intermediate transfer belt 12 is sandwiched by secondary-transfer roller 23 and secondary-transfer opposed roller 24. A secondary-transfer nip is formed between secondary-transfer roller 23 and secondary-transfer opposed roller 24 sandwiching intermediate transfer belt 12.

Secondary-transfer voltage generator 55 (FIG. 3) applies a predetermined direct-current voltage, namely a secondary-transfer voltage, to metal shaft 23*b* of secondary-transfer roller 23. This secondary-transfer voltage causes the toner images on the surface of intermediate transfer belt 12 to be transferred onto recording medium 80 fed from feeder mechanism 16.

Downstream of the secondary-transfer device in the medium conveyance direction, guide 27 is provided to guide recording medium 80 to fixation device 29 to be described later. Secondary-transfer exit sensor 28 is also provided downstream of the secondary-transfer device. Secondary-transfer exit sensor 28 is used to monitor if recording medium 80 gets stuck on secondary-transfer roller 23 or fails to be released from intermediate transfer belt 12.

Fixation device 29 is located downstream of the secondary-transfer device in the medium conveyance direction. Fixation device 29 fuses the toners transferred onto recording medium 80 by the secondary-transfer device by applying heat and pressure, and thereby fixes the toners onto recording medium 80. Fixation device 29 includes heat roller 30, pressure roller 31, and thermistor 33.

Heat roller 30 is driven and rotated by a force produced by heater motor 49 (FIG. 3). Pressure roller 31 rotates by following the rotation of heat roller 30. Heat roller 30 has heater 32 inside, with heater 32 including a halogen lamp serving as a heat source. Thermistor 33 is located near the surface of heat roller 30 and detects the temperature of heat roller 30.

Fixation exit sensor 34 is located close to and downstream of heat roller 30 in the medium conveyance direction. Fixation exit sensor 34 is used to monitor if a paper jam occurs in fixation device 29 or if recording medium 80 gets stuck on heat roller 30.

Guide 36 is located downstream of fixation device 29 in the medium conveyance direction to navigate recording medium 80, on which the toner images are fixed, to stacker 35 which is located in an upper portion of image formation apparatus 1.

Provided inside guide 36 are conveyance roller pair 37, conveyance roller pair 38, and conveyance roller pair 39 that convey recording medium 80 to stacker 35. Conveyance roller pair 37, conveyance roller pair 38, and conveyance roller pair 39 are driven by conveyance motor 48 (FIG. 3). Recording medium 80 on which toner images are fixed is conveyed by conveyance roller pair 37, conveyance roller pair 38, and conveyance roller pair 39, and is placed on stacker 35.

Cleaner blade 25 is located downstream of secondary-transfer roller 23 in the moving direction of intermediate transfer belt 12. Cleaner blade 25 scrapes off and removes toners not transferred by secondary-transfer device onto recording medium 80 and left on the surface of intermediate transfer belt 12 (hereinafter referred to as secondary-transfer residual toners).

In an example herein, cleaner blade 25 is in contact with a portion of intermediate transfer belt 12 curving along driven roller 14. Cleaner blade 25 is made of a flexible rubber or a flexible plastic. Waste toner tank 26 is located below cleaner blade 25 to collect the secondary-transfer residual toners scraped off by cleaner blade 25.

Configuration of the Secondary-Transfer Device

Figure 2:
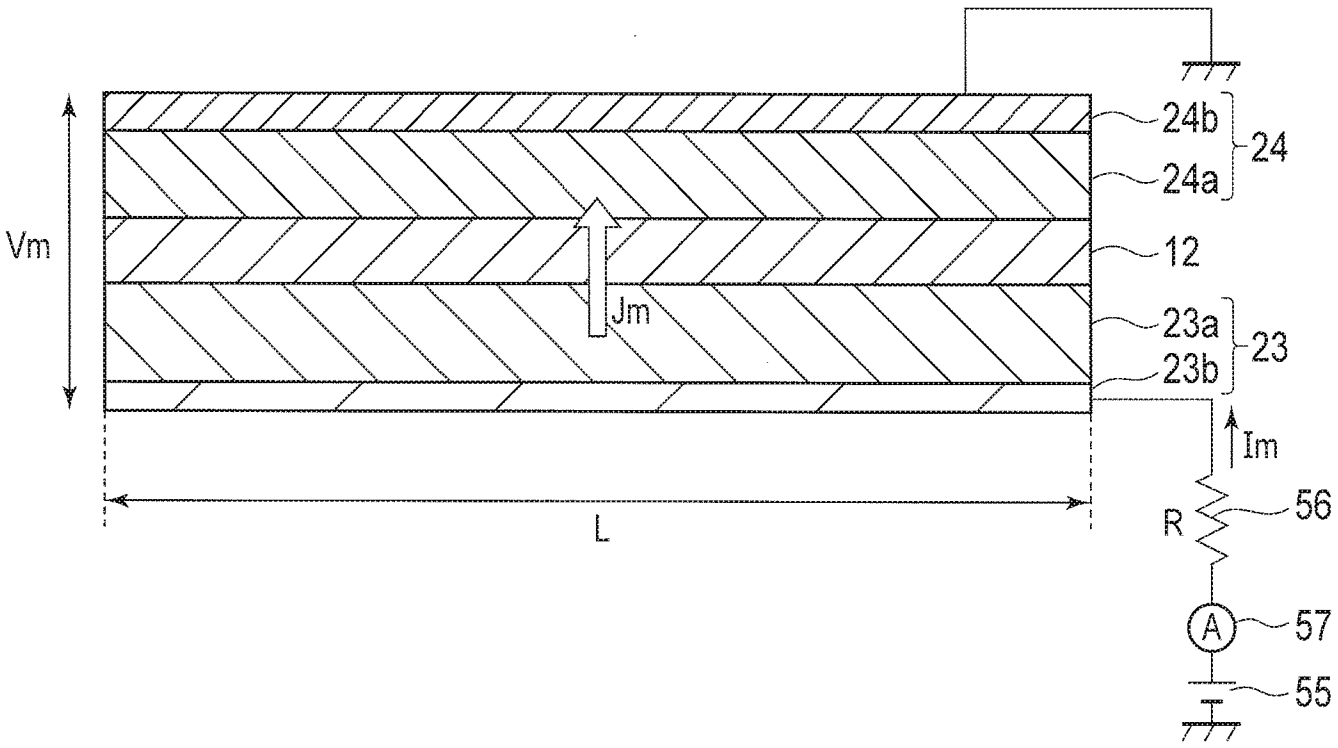
FIG. 2 is a schematic diagram illustrating a secondary-transfer nip in the image formation apparatus of the first embodiment.

FIG. 2 is a schematic diagram illustrating the secondary-transfer nip formed by secondary-transfer roller 23 and secondary-transfer opposed roller 24. As illustrated in FIG. 2, secondary-transfer roller 23 and secondary-transfer opposed roller 24 face each other with intermediate transfer belt 12 sandwiched by them. Note that FIG. 2 omits any illustration of the lower half of elastic layer 23*a* of secondary-transfer roller 23 and the upper half of metal roller 24*a* of secondary-transfer opposed roller 24.

Metal shaft 23*b* of secondary-transfer roller 23 is connected to secondary-transfer voltage generator 55 described earlier via fixed resistor 56. Fixed resistor 56 is provided to reduce resistance value variations in the circumferential direction of secondary-transfer roller 23 so that a transfer failure may not occur.

Secondary-transfer current measurer 57 is connected between fixed resistor 56 and secondary-transfer voltage generator 55. Secondary-transfer current measurer 57 measures a secondary-transfer current flowing through secondary-transfer roller 23.

Metal shaft 24*b* of secondary-transfer opposed roller 24 is connected with the ground (i.e., is grounded). Metal shaft 24*b* and metal roller 24*a* of secondary-transfer opposed roller 24 have the same potential.

Control System

FIG. 3 is a block diagram illustrating a control system of image formation apparatus 1. In FIG. 3, host interface device 40 acts as a physical layer interface between image formation apparatus 1 and the host computer (an external device).

Command and image processor 41 analyzes commands sent from the host computer, and also converts image data into bitmap data.

LED head interface device 42 processes the bitmap data obtained by command and image processor 41 according to the interfaces for LED heads 11K, 11Y, 11M, and 11C for the respective colors.

Main controller (also called an engine controller) 43 controls the parts of image formation apparatus 1, and a central processing unit (CPU) is one example of main controller 43. Main controller 43 receives commands from command and image processor 41 and signals regarding the medium conveyance from sheet feed sensor 22, secondary-transfer exit sensor 28, and fixation exit sensor 34. Based on these commands and signals, main controller 43 controls how hopping motor 44, registration motor 45, belt motor 46, drum motor 47, conveyance motor 48, and heater motor 49 are driven.

Main controller 43 also receives a temperature signal from thermistor 33, and controls the temperature of heater 32 based on this signal. Main controller 43 also controls high voltage controller 50, to be described below, regarding voltage output.

As instructed by main controller 43, high voltage controller 50 controls charge voltage generator 51, supply voltage generator 52, development voltage generator 53, primary-transfer voltage generator 54, secondary-transfer voltage generator 55, and secondary-transfer current measurer 57. As described later, high voltage controller 50 controls secondary-transfer voltage generator 55 based on the calculation results obtained by recording medium width calculator 58.

As instructed by high voltage controller 50, charge voltage generator 51 controls a charge voltage to apply to charge rollers 3K, 3Y, 3M, and 3C.

As instructed by high voltage controller 50, supply voltage generator 52 controls a supply voltage to apply to supply rollers 7K, 7Y, 7M, and 7C.

As instructed by high voltage controller 50, development voltage generator 53 controls a development voltage to apply to developer rollers 5K, 5Y, 5M, and 5C.

As instructed by high voltage controller 50, primary-transfer voltage generator 54 controls primary-transfer voltages to apply to primary-transfer rollers 10K, 10Y, 10M, and 10C.

As instructed by high voltage controller 50, secondary-transfer voltage generator 55 (a voltage applier) controls a secondary-transfer voltage to apply to secondary-transfer roller 23 via fixed resistor 56.

As instructed by high voltage controller 50, secondary-transfer current measurer 57 measures a secondary-transfer current flowing through secondary-transfer roller 23.

Based on a current value measured by secondary-transfer current measurer 57, recording medium width calculator 58 calculates the width of recording medium 80 (the width in a direction orthogonal to the medium conveyance direction).

Recording medium settings detector 61 acquires settings on recording medium 80 made by a user on operation panel 60.

Memory 59 has stored therein set values for charge voltage generator 51, supply voltage generator 52, development voltage generator 53, primary-transfer voltage generator 54, and secondary-transfer voltage generator 55.

Operation panel 60 allows a user to make settings on recording medium 80 used for printing. In this embodiment, settings on recording medium 80 that a user can make include the type and the size (width and length) of recording medium 80. Operation panel 60 also receives, from a user, an instruction to calculate the width of recording medium 80.

Note that high voltage controller 50, secondary-transfer current measurer 57, recording medium width calculator 58, and memory 59 constitute a voltage controller that acquires the width of recording medium 80 and controls secondary-transfer voltage generator 55 according to the width acquired. Secondary-transfer current measurer 57 and recording medium width calculator 58 constitute a recording medium width detector that detects the width of recording medium 80. High voltage controller 50 and recording medium width calculator 58 may be realized as a circuit such as an Application Specific Integrated Circuit (ASIC).

Operation of the Image Formation Apparatus

Next, a description is given of the print operation (image formation) of image formation apparatus 1 according to this embodiment. In FIG. 3, image formation apparatus 1 starts the print operation when receiving image data from the host computer via host interface device 40.

Command and image processor 41 instructs main controller 43 to start warming up fixation device 29, and also, generates bitmap data for each page for each color by converting the image data.

Instructed by command and image processor 41 to start warming up fixation device 29, main controller 43 controls heater motor 49 to drive heat roller 30 and turns heater 32 on and off based on signals from thermistor 33 to adjust a temperature of heat roller 30. The temperature of hear roller 30 corresponds to a fixation temperature.

Once the temperature of heat roller 30 reaches a predetermined temperature that allows for a fusing of the toner images, main controller 43 starts a print process. First, main controller 43 controls belt motor 46, drum motor 47, and conveyance motor 48 to drive roller 13, the rollers of process devices 2K, 2Y, 2M, and 2C, and secondary-transfer roller 23. Main controller 43 instructs high voltage controller 50 about the voltage output.

Instructed by main controller 43 to output voltages, high voltage controller 50 retrieves set values of the charge voltage, supply voltage, and development voltage stored in memory 59, and causes charge voltage generator 51, supply voltage generator 52, and development voltage generator 53 to apply bias voltages (the charge voltage, the supply voltage, and the development voltage) to the corresponding rollers of process devices 2K, 2Y, 2M, and 2C.

Next, a description is given of how process devices 2K, 2Y, 2M, and 2C form toner images. Process device 2K for black is used as an example here. Process devices 2Y, 2M, and 2C for yellow, magenta, and cyan form toner images in the same manner as process device 2K for black does.

By the above-described control of the voltage application by high voltage controller 50, a charge voltage of −1100 V is applied to charge roller 3K, which causes the surface of photosensitive drum 4K to be charged to −600 V. Also, a development voltage of −200 V is applied to developer roller 5K, and a supply voltage of −250 V is applied to supply roller 7K. By these voltages, an electric field is formed near a nip area between developer roller 5K and supply roller 7K, the electric field being directed from developer roller 5K to supply roller 7K.

Toner cartridge 9K of process device 2K contains a black toner, and the toner supplied from toner cartridge 9K is rubbed hard by developer roller 5K and supply roller 7K and is frictionally charged as a result. The toner's frictional charge is negative in this example. The negatively frictionally charged toner is attached to the surface of developer roller 5K due to a Coulomb force induced by the electric field directed from developer roller 5K to supply roller 7K.

As developer roller 5K rotates, the toner attached to the surface of developer roller 5K arrives at a contact area between developer roller 5K and developing blade 6K. At the contact area, the toner is evened out by developing blade 6K and is thereby formed into a toner layer with an even thickness. As developer roller 5K further rotates, the toner layer arrives at the nip between developer roller 5K and photosensitive drum 4K.

In the meantime, command and image processor 41 sends bitmap data on each page to LED head interface device 42. LED head interface device 42 causes an LED, corresponding to the received bitmap data, in LED head 11K to emit light. In an area of photosensitive drum 4K exposed to the light, the potential of photosensitive drum 4K charged at −600 V drops to −50 V, and an electrostatic latent image is formed there.

As photosensitive drum 4K rotates, the electrostatic latent image formed on the surface of photosensitive drum 4K arrives at the nip area between photosensitive drum 4K and developer roller 5K. Between developer roller 5K and photosensitive drum 4K, an electric field directed from photosensitive drum 4K to developer roller 5K is formed in the exposed area of photosensitive drum 4K where the potential has dropped to −50 V, and an electric field directed from developer roller 5K to photosensitive drum 4K is formed in an unexposed area of photosensitive drum 4K where the potential is still −600 V. Thus, the negatively charged toner on the surface of developer roller 5K is attached to the exposed area of photosensitive drum 4K. In other words, the electrostatic latent image is developed and becomes a toner image (a developer image).

When the toner images of the respective colors formed on photosensitive drums 4K, 4Y, 4M, and 4C of process devices 2K, 2Y, 2M, and 2C arrive at the respective primary-transfer nips, main controller 43 instructs high voltage controller 50 about application of a primary-transfer voltage.

High voltage controller 50 retrieves a set value of a primary-transfer voltage stored in memory 59 and causes primary-transfer voltage generator 54 to respectively apply the primary-transfer voltages to primary-transfer rollers 10K, 10Y, 10M, and 10C. In this example, each of the primary-transfer voltages is +3000 V.

Electric fields respectively directed from primary-transfer rollers 10K, 10Y, 10M, and 10C to photosensitive drums 4K, 4Y, 4M, and 4C are formed at the primary-transfer nips, and the negatively-charged toner images developed on photosensitive drums 4K, 4Y, 4M, and 4C are transferred onto intermediate transfer belt 12 (primary transfer).

In the time between when the image data is received from the host computer and when the primary-transfer toner image on intermediate transfer belt 12 arrives at the secondary-transfer nip, high voltage controller 50 calculates the secondary-transfer voltages (secondary-transfer voltages Vtr) which secondary-transfer voltage generator 55 applies to secondary-transfer roller 23 to transfer the primary-transfer toner image on intermediate transfer belt 12 onto recording medium 80 (secondary transfer).

Secondary-transfer voltages Vtr are calculated based on calculation results obtained by recording medium width calculator 58 and set values prepared for the calculation of the secondary-transfer voltages and stored in memory 59. The timing for calculating secondary-transfer voltages Vtr is not limited to the above timing. Secondary-transfer voltages Vtr may be calculated at any timing as long as at least intermediate transfer belt 12 and secondary-transfer roller 23 are being driven and recording medium 80 is not at the secondary-transfer nip.

Next, before the primary-transfer toner image on intermediate transfer belt 12 arrives at the secondary-transfer nip, main controller 43 drives hopping motor 44 to rotate hopping roller 18 so that one of recording media 80 in media cassette 17 is conveyed to an area between pinch roller 19 and registration roller 20.

Main controller 43 stops hopping motor 44 when main controller 43 detects that a leading edge of recording media 80 in the medium conveyance direction has arrived at the area between pinch roller 19 and registration roller 20 based on the output from feed sensor 22.

Main controller 43 drives registration motor 45 so that recording medium 80 between pinch roller 19 and registration roller 20 may be conveyed to the secondary-transfer nip along guide 21 when the primary-transfer tone image on intermediate transfer belt 12 arrives at the secondary-transfer nip.

At the same time, main controller 43 instructs high voltage controller 50 about an application of secondary-transfer voltages Vtr so that secondary-transfer voltage generator 55 may apply secondary-transfer voltages Vtr to secondary-transfer roller 23 when the primary-transfer tone image on intermediate transfer belt 12 arrives at the secondary-transfer nip.

In the secondary-transfer nip, an electric field directed from secondary-transfer roller 23 to secondary-transfer opposed roller 24 is formed, and thereby the negatively-charged primary-transfer toner image on intermediate transfer belt 12 is transferred onto recording medium 80 (secondary transfer).

Main controller 43 keeps driving registration motor 45 and belt motor 46 while monitoring, using secondary-transfer exit sensor 28, if recording medium 80 gets stuck on secondary-transfer roller 23 or fails to be released from intermediate transfer belt 12. Recording medium 80 which has thus completed the secondary transfer is conveyed along guide 27 and arrives at fixation device 29.

Recording medium 80 is inserted into a fixation nip between heat roller 30 which has reached a toner-fusible temperature and pressure roller 31 which is in pressure contact with heat roller 30. Heat roller 30 and pressure roller 31 apply heat and pressure to the toners on recording medium 80, thereby fusing and fixing the toner onto recording medium 80. The toner-fusible temperature corresponds to a fixable temperature.

Before recording medium 80 on which the toners have been fixed arrives at guide 36, main controller 43 drives conveyance motor 48 to rotate conveyance roller pair 37, conveyance roller pair 38, and conveyance roller pair 39.

Main controller 43 keeps driving conveyance motor 48 while monitoring, using fixation exit sensor 34, if a jam occurs in fixation device 29 or if recording medium 80 gets stuck on heat roller 30. Recording medium 80 is thus conveyed by conveyance roller pair 37, conveyance roller pair 38, and conveyance roller pair 39 along guide 36 and is discharged onto stacker 35.

In parallel with the fixing process, cleaner blade 25 scrapes off the secondary-transfer residual toner(s) on the surface of intermediate transfer belt 12 and the residual toner(s) is (are) collected in waste toner tank 26.

When the above steps are complete, main controller 43 stops belt motor 46, drum motor 47, and conveyance motor 48. At the same time, main controller 43 instructs high voltage controller 50 and thereby causes charge voltage generator 51, supply voltage generator 52, and development voltage generator 53 to stop supplying the bias voltages to the rollers of process devices 2K, 2Y, 2M, and 2C. Main controller 43 also stops heater motor 49 and heater 32, and the print operation is thereby completed.

Method of Calculating the Secondary-Transfer Voltage

Figures 4, 5, 6:
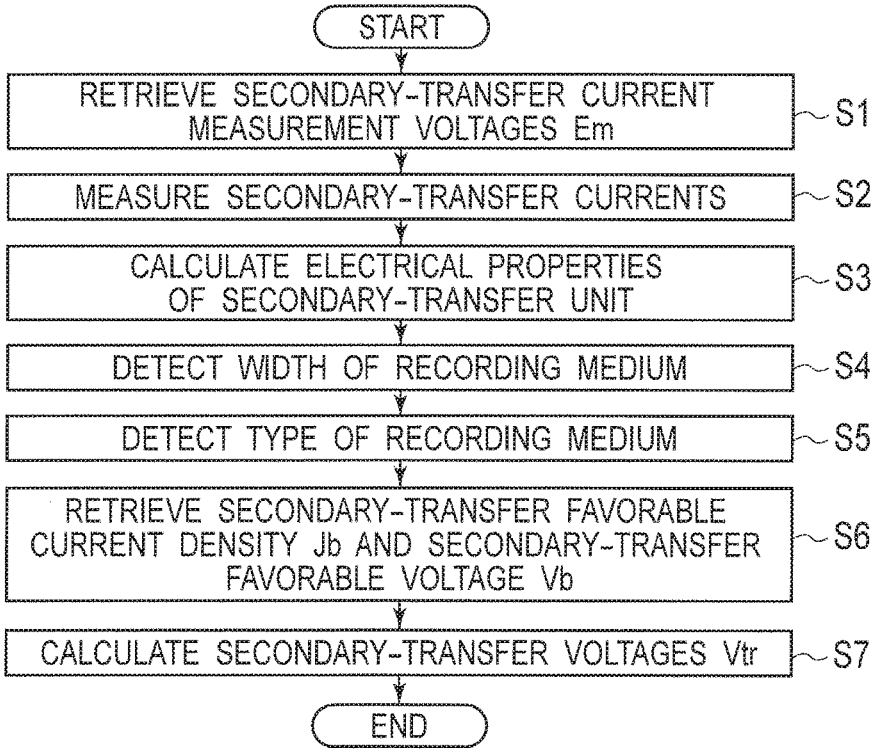
FIG. 4 is a flowchart illustrating a process of calculating secondary-transfer voltages in the first embodiment.
FIG. 5 is a diagram illustrating an example of a secondary-transfer current measurement voltage table stored in a memory in the first embodiment.
FIG. 6 is a diagram illustrating an example of a first secondary-transfer current table stored in the memory in the first embodiment.

Next, a method of calculating secondary-transfer voltages Vtr is described. FIG. 4 is a flowchart illustrating a process of calculating secondary-transfer voltages Vtr. When main controller 43 receives image data from the host computer, high voltage controller 50 starts a calculation of secondary-transfer voltages Vtr.

High voltage controller 50 retrieves secondary-transfer current measurement voltage Em stored in memory 59 (Step S1). Secondary-transfer current measurement voltage Em is a secondary-transfer voltage applied by secondary-transfer voltage generator 55 to secondary-transfer roller 23 to measure a secondary-transfer current (first current) flowing through secondary-transfer roller 23 with no recording medium 80 present at the secondary-transfer nip.

FIG. 5 is a diagram illustrating an example of secondary-transfer current measurement voltage table 62 stored in memory 59. Herein, secondary-transfer current measurement voltage table 62 has stored therein two secondary-transfer current measurement voltages Em1 and Em2 [V]. The number of secondary-transfer current measurement voltages Em is not limited, and more than two secondary-transfer current measurement voltages Em may be stored.

High voltage controller 50 causes secondary-transfer voltage generator 55 to sequentially apply the thus-retrieved secondary-transfer current measurement voltages Em1 and Em2 to secondary-transfer roller 23 and causes secondary-transfer current measurer 57 to measure secondary-transfer currents Im1 and Im2 (first currents) that flow through secondary-transfer roller 23 (Step S2). Secondary-transfer currents Im1 and Im2 measured by secondary-transfer current measurer 57 are stored in memory 59 as first secondary-transfer current table 63.

FIG. 6 is a diagram illustrating an example of first secondary-transfer current table 63 stored in memory 59. First secondary-transfer current table 63 has stored therein secondary-transfer current Im1 [μA] for secondary-transfer current measurement voltage Em1 and secondary-transfer current Im2 [μA] for secondary-transfer current measurement voltage Em2.

Based on measurement results obtained in Step S2, high voltage controller 50 calculates electrical properties of the secondary-transfer device (Step S3). The electrical properties of the secondary-transfer device calculated here is the relation between a voltage [V] exerted between metal shaft 23*b* of secondary-transfer roller 23 and metal shaft 24*b* of secondary-transfer opposed roller 24 (hereinafter referred to as secondary-transfer inter-shaft voltage V), and the density of the secondary-transfer current per unit length [μA/mm] (hereinafter referred to as secondary-transfer current density J).

The following Formula (1), which is a linear approximation expression obtained by the relation between secondary-transfer inter-shaft voltage V and secondary-transfer current density J, is used for the calculation of the electrical properties:

$$V=a\times J+b. \tag{1}$$

Secondary-transfer inter-shaft voltage Vm [V] is a voltage exerted between metal shaft 23*b* of secondary-transfer roller 23 and metal shaft 24*b* of secondary-transfer opposed roller 24 when secondary-transfer current measurement voltage Em [V] is applied to secondary-transfer roller 23. Secondary-transfer current density Jm [μA/mm] is the density, per unit length, of secondary-transfer current Im [μA] flowing through secondary-transfer roller 23.

Secondary-transfer inter-shaft voltages Vm1 and Vm2 [V] for secondary-transfer current measurement voltages Em1 and Em2 [V] illustrated in FIG. 5 and secondary-transfer currents Im1 and Im2 [μA] illustrated in FIG. 6 can be expressed by the following Formulae (2) and (3), respectively:

$$Vm1=Em1-Im1\times R, \text{ and} \tag{2}$$

$$Vm2=Em2-Im2\times R \tag{3}$$

where R is a resistance value (MΩ) of fixed resistor 56.

Secondary-transfer current densities Jm1 and Jm2 [μA/mm] can be expressed by the following Formulae (4) and (5), respectively:

$$Jm1=Im1/L, \text{ and} \tag{4}$$

$$Jm2=Im2/L \tag{5}$$

where L is the length [mm] of secondary-transfer roller 23 in a direction orthogonal to the moving direction of the intermediate transfer belt 12 (the medium conveyance direction).

Figure 7:
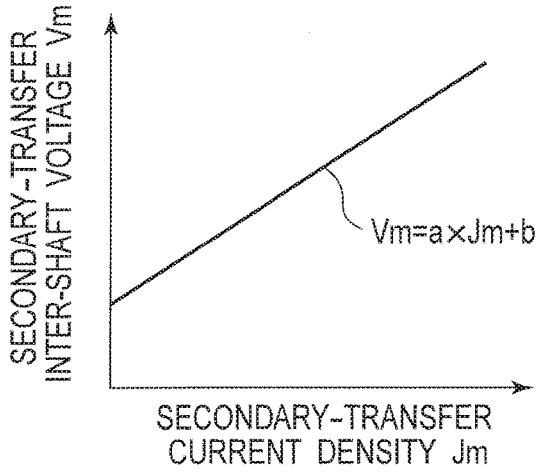
FIG. 7 is a graph illustrating the relation between a secondary-transfer current density and a secondary-transfer inter-shaft voltage in the first embodiment.

Secondary-transfer inter-shaft voltage Vm (Vm1, Vm2) and secondary-transfer current density Jm (Jm1, Jm2) can be approximated using the aforementioned Formula (1), namely, as a linear function as illustrated in FIG. 7: Vm=a×Jm+b. Coefficients a and b are found by the following Formulae (6) and (7), respectively:

$$a=(Vm2-Vm1)/(Jm2-Jm1), \text{ and} \tag{6}$$

$$b=(Vm1\times Jm2-Vm2\times Jm1)/(Jm2-Jm1). \tag{7}$$

The values of these coefficients a and b represent the electrical properties of the secondary-transfer device.

Next, high voltage controller 50 retrieves information on widths W of recording medium 80 calculated by recording medium width calculator 58 from recording medium width table 66 in memory 59 (Step S4). A description is now given of a method of calculating the widths of recording medium 80.

Figure 8:
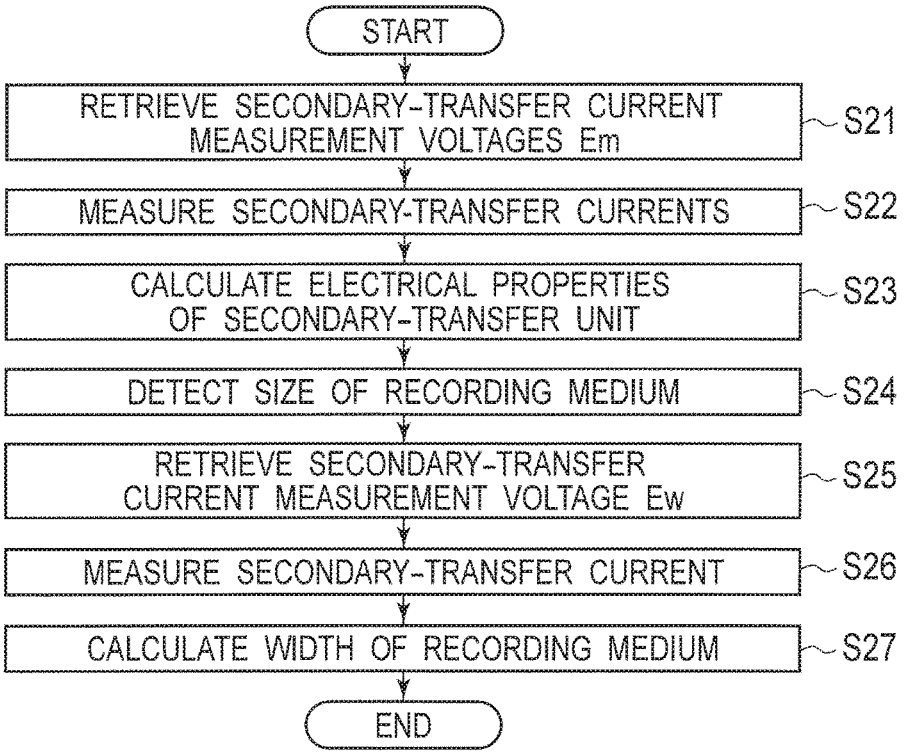
FIG. 8 is a flowchart illustrating a process of calculating the width of a recording medium in the first embodiment.

FIG. 8 is a flowchart illustrating a process of calculating the widths of recording medium 80. A secondary-transfer current flows through secondary-transfer roller 23, recording medium 80, intermediate transfer belt 12, and secondary-transfer opposed roller 24. Thus, a change in the width of recording medium 80 changes the secondary-transfer current. Thus, the width of recording medium 80 can be calculated based on an amount of change in the secondary-transfer current.

In this embodiment, high voltage controller 50 causes secondary-transfer voltage generator 55 to apply a predetermined secondary-transfer voltage to secondary-transfer roller 23. Then, high voltage controller 50 causes secondary-transfer current measurer 57 to measure the secondary-transfer current flowing through secondary-transfer roller 23. Thereby, recording medium width calculator 58 calculates width W of recording medium 80. The application of the secondary-transfer voltage and measurement of the secondary-transfer current are performed from when recording medium 80 arrives at secondary-transfer nip to when recording medium 80 leaves secondary-transfer nip.

Here, the process of calculating the width of recording medium 80 is performed before the print operation starts. More specifically, the width of recording medium 80 is calculated in the time between when a user places recording medium 80 in media cassette 17 and when the user sends image data from the host computer.

In this width calculation of recording medium 80, process devices 2K, 2Y, 2M, and 2C do not form toner images (as in printing a blank page), and recording medium 80 is fed from media cassette 17 with heater 32 of fixation device 29 being turned off.

When main controller 43 receives an instruction, entered by a user on operation panel 60, to execute the process of calculating the width of recording medium 80, main controller 43 instructs recording medium width calculator 58 to calculate the width of recording medium 80.

Steps S21 to S23 are the same as Steps S1 to S3 described earlier. Specifically, recording medium width calculator 58 retrieves secondary-transfer current measurement voltages Em1 and Em2 stored in memory 59 (Step S21), and high voltage controller 50 causes secondary-transfer voltage generator 55 to apply the thus-retrieved secondary-transfer current measurement voltages Em1 and Em2 to secondary-transfer roller 23 sequentially and causes secondary-transfer current measurer 57 to measure secondary-transfer currents Im1 and Im2 flowing through secondary-transfer roller 23 (Step S22). Based on the measurement results obtained in Step S22, high voltage controller 50 calculates the electrical properties of the secondary-transfer device, that is, the values of coefficients a and b in Formula (1) (Step S23).

Next, recording medium settings detector 61 retrieves information on the size of recording medium 80 from the information on recording medium 80 entered by the user on operation panel 60 (Step S24).

The information on the size of recording medium 80 includes a maximum width Wmax [mm] of recording medium 80 in the direction orthogonal to the medium conveyance direction and the length Mw [mm] of recording medium 80 in the medium conveyance direction.

Figures 9, 10:
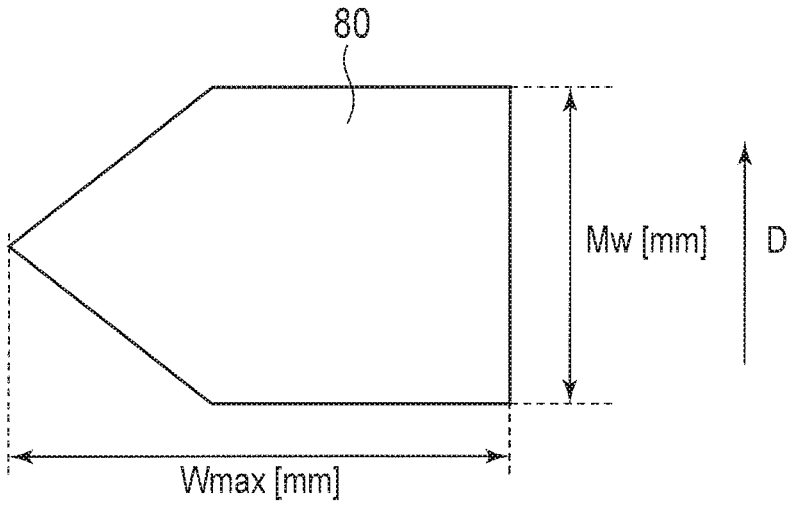
FIG. 9 is a schematic diagram illustrating the shape of a recording medium used in the first embodiment.
FIG. 10 is a diagram illustrating an example of a second secondary-transfer current table stored in the memory in the first embodiment.

FIG. 9 is a schematic diagram illustrating an example of the shape of recording medium 80 used in this embodiment. Length Mw of recording medium 80 in the medium conveyance direction (denoted by arrow Din FIG. 9) is 100 mm in this example. Recording medium 80 has such a shape that its width W increases linearly from the leading edge to the center in the medium conveyance direction and decreases linearly from the center to the tailing edge in the medium conveyance direction. Thus, recording medium 80 has a maximum width Wmax at its center portion in the medium conveyance direction.

In the following, the width of recording medium 80 in the direction orthogonal to the medium conveyance direction is referred to simply as "the width of recording medium 80".

Next, high voltage controller 50 retrieves secondary-transfer current measurement voltage Ew stored in memory 59 (Step S25). Secondary-transfer current measurement voltage Ew is a secondary-transfer voltage applied, for the calculation of the width of recording medium 80, by secondary-transfer voltage generator 55 to secondary-transfer roller 23 in the time between when recording medium 80 arrives at the secondary-transfer nip and when recording medium 80 leaves the secondary-transfer nip.

Although two secondary-transfer current measurement voltages (Em1, Em2) are set as secondary-transfer current measurement voltage Em as illustrated in FIG. 5, only one secondary-transfer current measurement voltage may be set as secondary-transfer current measurement voltage Ew for the calculation of the width of recording medium 80.

High voltage controller 50 causes secondary-transfer voltage generator 55 to apply the thus-retrieved secondary-transfer current measurement voltage Ew to secondary-transfer roller 23 when recording medium 80 arrives at the secondary-transfer nip. Then, secondary-transfer current measurer 57 measures secondary-transfer current Iw (a second current) flowing through secondary-transfer roller 23 at a predetermined interval d (Step S26).

Secondary-transfer current measurer 57 starts measuring secondary-transfer current Iw when the leading edge of recording medium 80 arrives at the secondary-transfer nip. Specifically, once the leading edge of recording medium 80 arrives at the secondary-transfer nip, secondary-transfer current measurer 57 measures secondary-transfer current Iw every time recording medium 80 is conveyed by a predetermined distance d [mm]. Secondary-transfer current measurer 57 finishes measuring secondary-transfer current Iw when the tailing edge of recording medium 80 (a position which is a length Mw away from the leading edge of recording medium 80) leaves the secondary-transfer nip.

Interval d [mm] at which secondary-transfer current measurer 57 measures secondary-transfer current Iw is, but not limited to, 1 mm in this example. Interval d may be changed according to necessity. Secondary-transfer currents Iw measured by secondary-transfer current measurer 57 are stored in memory 59 as second secondary-transfer current table 65.

FIG. 10 is a diagram illustrating an example of second secondary-transfer current table 65. In this table, Iw0 is secondary-transfer current Iw [μA] measured when the leading edge of recording medium 80 arrives at the secondary-transfer nip. Iw1 is secondary-transfer current Iw [μA] measured when recording medium 80 is conveyed by a predetermined distance d from the above-mentioned position (in other words, at measurement position d). Similarly, Iw2, Iw3, Iw4, etc. are secondary-transfer currents Iw [μA] measured at measurement positions 2*d*, 3*d*, 4*d*, etc., respectively.

Recording medium width calculator 58 calculates the widths of recording medium 80 based on the electrical properties of the secondary-transfer device (the values of coefficients a and b) calculated in Step S23, maximum width Wmax [mm] of recording medium 80 retrieved in Step S24, and secondary-transfer currents Iw measured in Step S26 at the respective measurement positions (positions along the medium conveyance direction) (Step S27).

Figure 11:
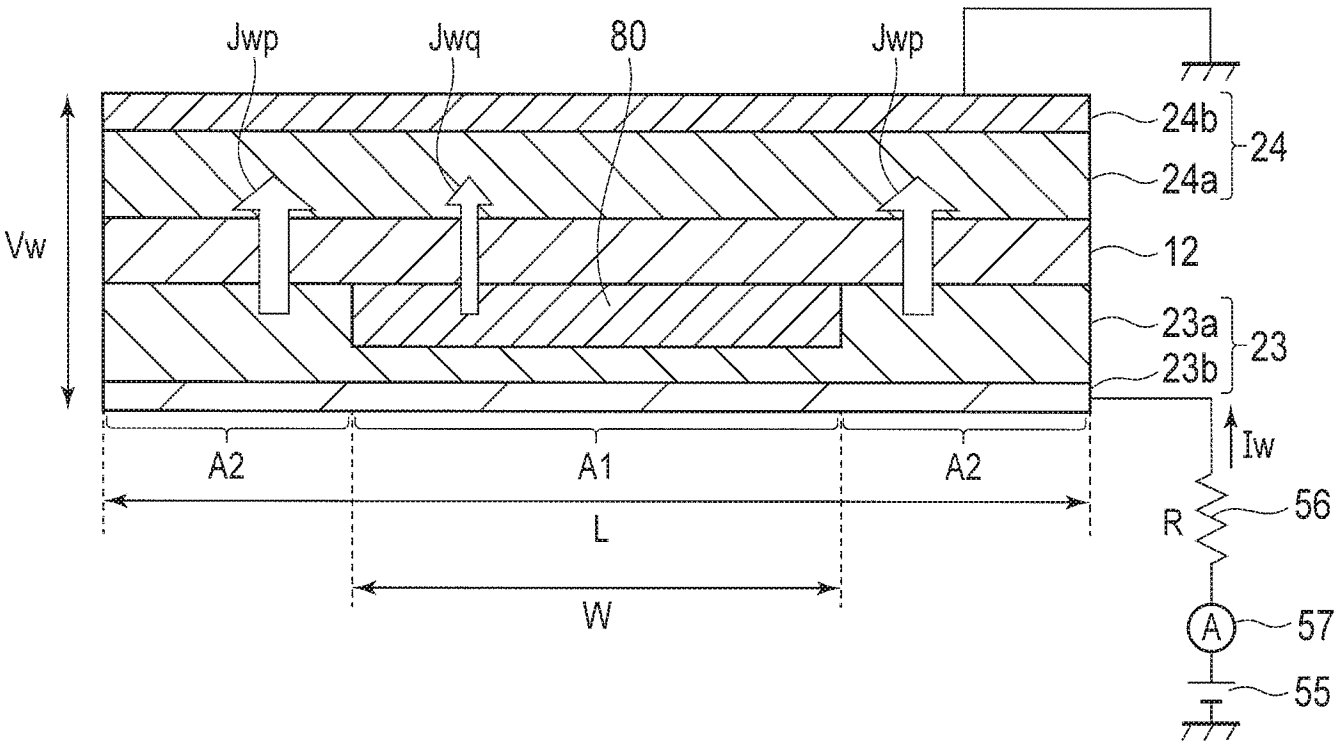
FIG. 11 is a schematic diagram illustrating the process of calculating the width of a recording medium in the first embodiment.

FIG. 11 is a schematic diagram illustrating the method of calculating the width of recording medium 80, and is used to describe the method of calculating the width of recording medium 80. First, recording medium width calculator 58 selects the smallest secondary-transfer current Iw value in second secondary-transfer current table 65 (FIG. 10). Assume here that secondary-transfer current Iw at measurement position 50*d* is the smallest value.

As illustrated in FIG. 11, a cross section of the secondary-transfer nip in a direction perpendicular to the medium conveyance direction has recording medium area A1 where recording medium 80 is present and medium outside area A2 where recording medium 80 is absent. A current flows through recording medium area A1 with more difficulty than through medium outside area A2 by the resistance value of recording medium 80. Thus, the wider recording medium 80 is, the smaller the secondary-transfer current is.

Hence, the smallest secondary-transfer current Iw value in second secondary-transfer current table 65 corresponds to the maximum width Wmax of recording medium 80. Since maximum width Wmax of recording medium 80 has been obtained in Step S24, the widths of recording medium 80 at other measurement positions can be calculated using, as a reference, secondary-transfer current Iw that has flowed through the maximum width Wmax location on recording medium 80 (such secondary-transfer current Iw used as a reference is referred to as secondary-transfer current $Iw_{ref}$ hereinbelow).

When secondary-transfer current measurement voltage Ew [V] is applied, secondary-transfer inter-shaft voltage Vw [V] is exerted between metal shaft 23*b* of secondary-transfer roller 23 and metal shaft 24*b* of secondary-transfer opposed roller 24.

Currents flowing through medium outside area A2 and recording medium area A1 when secondary-transfer current Iw [μA] flows through secondary-transfer roller 23 are secondary-transfer current Iwp [μA] and secondary-transfer current Iwq [μA], respectively. The current densities per unit length in medium outside area A2 and recording medium area A1 when secondary-transfer current Iw [μA] flows through secondary-transfer roller 23 are secondary-transfer current density Jwp [μA/mm] and secondary-transfer current density Jwq [μA/mm], respectively. A subscript "ref" is added to a voltage, a current, and a current density measured when the width of recording medium 80 is maximum width Wmax.

Secondary-transfer current Iwq flowing through recording medium area A1 when secondary-transfer current measurement voltage Ew [V] is applied is expressed as Jwq×W, and secondary-transfer current Iwp flowing through medium outside area A2 when secondary-transfer current measurement voltage Ew [V] is applied is expressed as Jwp×(L−W).

Secondary-transfer current Iw flowing through secondary-transfer roller 23 is the sum of secondary-transfer current Iwq and secondary-transfer current Iwp. Thus, secondary-transfer current Iw [μA] flowing through secondary-transfer roller 23 can be expressed as the following Formula (8):

$$Iw_{ref}=Jwq_{ref}\times W+Jwp_{ref}\times(L-W). \quad (8)$$

Secondary-transfer inter-shaft voltage $Vw_{ref}$ exerted by the application of secondary-transfer current measurement voltage Ew and measured at a position where recording medium 80 has its maximum width Wmax is found by the following Formula (9) using the value of secondary-transfer current $Iw_{ref}$ (FIG. 10) and resistance value R of fixed resistor 56:

$$Vw_{ref}=Ew-Iw_{ref}\times R. \quad (9)$$

By rearranging Formula (1) for J and substituting V with the value of $Vw_{ref}$ found by the above Formula (9), secondary-transfer current density $Jwp_{ref}$ per unit length in medium outside area A2 is found by the following Formula (10):

$$Jwp_{ref}=(Vw_{ref}-b)/a. \quad (10)$$

Using the value of $Jwp_{ref}$ found by the above Formula (10) as well as maximum width Wmax of recording medium 80 and length L of secondary-transfer roller 23, both of which have already been obtained, secondary-transfer current $Iwp_{ref}$ in medium outside area A2 is found by the following Formula (11):

$$Iwp_{ref}=Jwp_{ref}\times(L-W\max). \quad (11)$$

Using the value of $Iwp_{ref}$ found by the above Formula (11) and the value of secondary-transfer current $Iw_{ref}$ (FIG. 10), secondary-transfer current $Iwq_{ref}$ in recording medium area A1 is found by the following Formula (12):

$$Iwq_{ref}=Iw_{ref}-Iwp_{ref}. \quad (12)$$

Using the value of $Iwq_{ref}$ found by the above Formula (12) and length L of secondary-transfer roller 23, secondary-transfer current density $Jwq_{ref}$ per unit length in recording medium area A1 is found by the following Formula (13):

$$Jwq_{ref}=Iwq_{ref}/L. \quad (13)$$

Using the value of $Jwq_{ref}$ found by the above Formula (13) and the value of secondary-transfer inter-shaft voltage $Vw_{ref}$ found by Formula (9), resistance value Rw [MΩ] per unit length (unit width) of recording medium 80 is found by the following Formula (14):

$$Rw=Vw_{ref}/Jwq_{ref}. \quad (14)$$

Secondary-transfer inter-shaft voltage Vwn measured at each measurement position when secondary-transfer current measurement voltage Ew [V] is applied is found by the following Formula (15) using a resistance value R of fixed resistor 56:

$$Vwn=Ew-Iwn\times R. \quad (15)$$

Secondary-transfer current density Jwpn in medium outside area A2 at each measurement position is found using Formula (1) and therefore by the following Formula (16):

$$Jwpn=(Vwn-b)/a \quad (16)$$

where n is a variable (0, 1, 2, 3, 4, . . . N).

Secondary-transfer current density Jwqn in recording medium area A1 at each measurement position is calculated by dividing secondary-transfer inter-shaft voltage Vwn by resistance value Rw per unit length of recording medium 80, and is therefore found by the following Formula (17):

$$Jwqn=Vwn/Rw. \quad (17)$$

Width Wn of recording medium 80 at each measurement position is found by the following Formula (18) using secondary-transfer current densities Jwpn and Jwqn found by Formulae (16) and (17), respectively, the value of secondary-transfer current Iwn at each measurement position obtained from FIG. 10, and length L of secondary-transfer roller 23:

$$Wn=(Iwn-Jwpn\times L)/(Jwqn-Jwpn) \quad (18)$$

Recording medium width calculator 58 stores the thus-calculated width Wn of recording medium 80 at each measurement position, in memory 59 as recording medium width table 66. FIG. 12 is a diagram illustrating an example of recording medium width table 66. Recording medium width table 66 has stored therein widths of recording medium 80 (W0, W1, W2, W3, . . . ) for the respective measurement positions (0, d, 2*d*, 3*d*, . . . ) on recording medium 80.

Back to the process of calculating secondary-transfer voltages Vtr illustrated in FIG. 4, high voltage controller 50 retrieves recording medium width table 66 stored in memory 59 (Step S4).

Recording medium settings detector 61 retrieves information on the type of recording medium 80 from the information on recording medium 80 entered by the user on operation panel 60 (Step S5). Information on the type of recording medium 80 indicates the type of recording medium 80 categorized mainly by its resistance value, and is specifically, plain paper, heavy paper, or film paper here.

Although there are three types of recording medium 80, namely plain paper, heavy paper, and film paper in this example, the invention is not limited to these, and the types may be changed according to necessity and may include high-quality paper, recycled paper, glossy paper, and the like. Although the user enters the information on the type of recording medium 80 using operation panel 60 in this example, the invention is not limited to this, and the user may set the type information when sending image formation apparatus 1 image data that the user wants printed.

Based on the type of recording medium 80 detected by recording medium settings detector 61, high voltage controller 50 retrieves secondary-transfer favorable current density Jb and secondary-transfer favorable voltage Vb stored in memory 59 (Step S6).

FIG. 13 is a diagram illustrating an example of secondary-transfer favorable current density and voltage table 67 stored in memory 59. Secondary-transfer favorable current density Jb is the density of the secondary-transfer current flowing through recording medium area A1 necessary to achieve a favorable secondary transfer. Secondary-transfer favorable voltage Vb is a secondary-transfer voltage experienced by recording medium 80 when a current with secondary transfer favorable current density Jb flows.

Secondary-transfer favorable current density Jb and secondary-transfer favorable voltage Vb of secondary-transfer favorable current density and voltage table 67 are set for each of the types of recording medium 80 (which are, here, plain paper, heavy paper, and film paper). Secondary-transfer favorable current density Jb and secondary-transfer favorable voltage Vb are obtained in advance by experiment.

Figure 14:
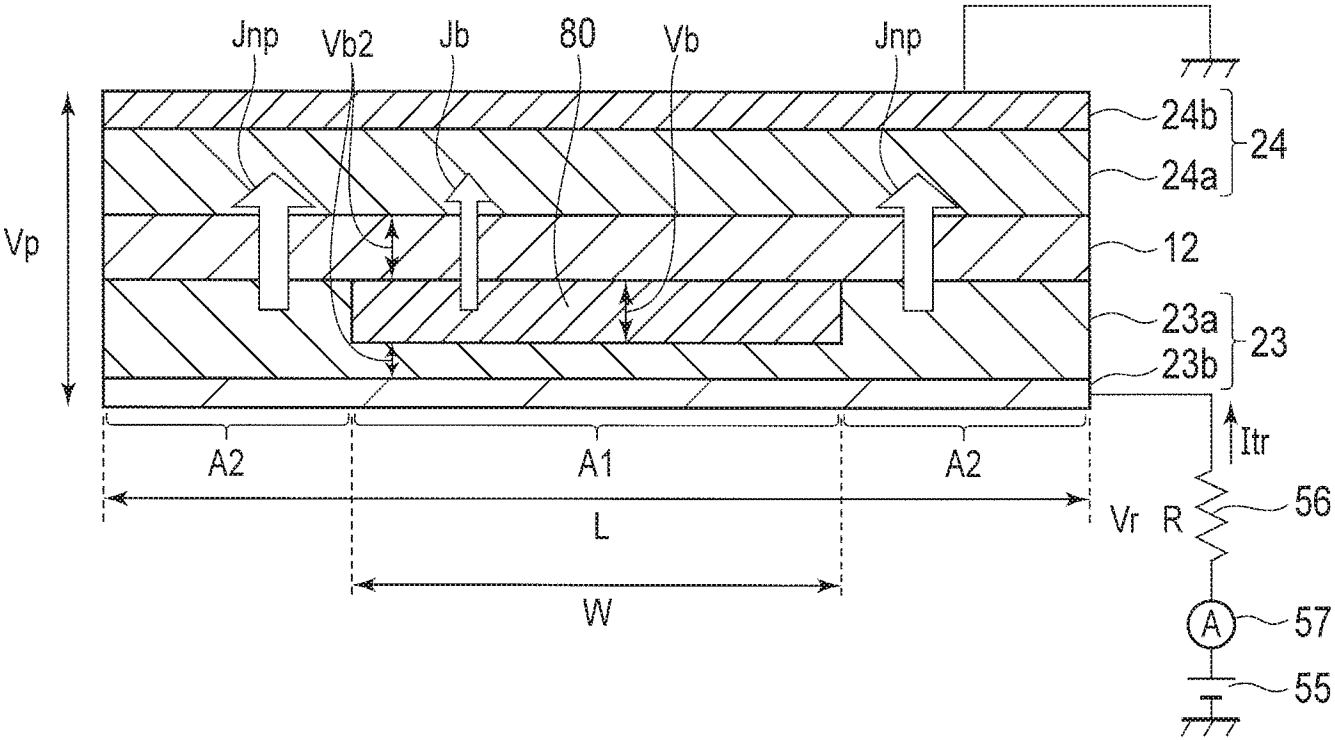
FIG. 14 is a schematic diagram illustrating the secondary-transfer nip during the secondary transfer performed by the image formation apparatus of the first embodiment.

FIG. 14 is a schematic diagram illustrating the secondary-transfer nip when toner images on intermediate transfer belt 12 are transferred onto recording medium 80 (secondary transfer). High voltage controller 50 calculates secondary-transfer voltages Vtr based on the electrical properties of the secondary-transfer device obtained in Step S3, widths W of recording medium 80 obtained in Step S4, and secondary-transfer favorable current density Jb and secondary-transfer favorable voltage Vb retrieved in Step S6 (Step S7). Assume here that the type of recording medium 80 retrieved by recording medium settings detector 61 is "plain paper".

First, using the electrical properties of the secondary-transfer device (the values of coefficients a and b) obtained in Step S3, secondary-transfer voltage Vb2 [V] experienced by recording medium area A1 excluding recording medium 80 when a current with secondary-transfer favorable current density Jb flows through recording medium 80 is found by the following Formula (19):

$$Vb2=a\times Jb1+b. \tag{19}$$

When recording medium 80 is present at the secondary-transfer nip, secondary-transfer inter-shaft voltage Vp [V] exerted between metal shaft 23*b* of secondary-transfer roller 23 and metal shaft 24*b* of secondary-transfer opposed roller 24 is the sum of secondary-transfer voltage Vb2 experienced by recording medium area A1 excluding recording medium 80 and secondary-transfer favorable voltage Vb experienced by recording medium 80, and is therefore found by the following Formula (20):

$$Vp=Vb+Vb2. \tag{20}$$

Using the electrical properties of the secondary transfer device obtained in Step S3, secondary-transfer current density Jnp [μA/mm] flowing through medium outside area A2 can be found by the following Formula (21):

$$Jnp=(Vp-b)/a. \tag{21}$$

Since secondary-transfer current Itr [μA] necessary to flow through secondary-transfer roller 23 to achieve a favorable secondary transfer on recording medium 80 having a width W obtained in Step S4 is the total of a secondary-transfer current flowing through recording medium area A1 and a secondary-transfer current flowing through medium outside area A2, and therefore can be found by the following Formula (22):

$$Itr=Jb\times W+Jnp\times(L-W). \tag{22}$$

Secondary-transfer currents Itr according to widths W of recording medium 80 at the respective measurement positions acquired in Step S4 are thus calculated using Formula (22).

Secondary-transfer voltage Vr [V] experienced by fixed resistor 56 when secondary-transfer current Itr [μA] flows through secondary-transfer roller 23 can be found by the following Formula (23):

$$Vr=Itr\times R. \tag{23}$$

Since secondary-transfer currents Itr are calculated based on the widths of recording medium 80 at the respective measurement positions obtained in Step S4, secondary-transfer voltages Vr, too, are calculated for the respective measurement positions (based on widths W of recording medium 80).

Secondary-transfer voltage Vtr [V] that secondary-transfer voltage generator 55 applies to the secondary-transfer roller 23 in order to pass secondary-transfer current Itr through secondary-transfer roller 23 is the total of secondary-transfer inter-shaft voltage Vp and secondary-transfer voltage Vr [V] experienced by fixed resistor 56, and therefore can be found by the following Formula (24):

$$Vtr=Vp+Vr. \tag{24}$$

High voltage controller 50 thus calculates secondary-transfer voltages Vtr based on the widths of recording medium 80 at the respective measurement positions obtained in Step S4. High voltage controller 50 stores the thus-calculated secondary-transfer voltages Vtr in memory 59 as secondary-transfer voltage table 68. FIG. 15 is a diagram illustrating an example of secondary-transfer voltage table 68.

As described above, main controller 43 instructs high voltage controller 50 about the application of secondary-transfer voltages so that high voltage controller 50 instructs secondary-transfer voltage generator 55 to apply secondary-transfer voltages Vtr to secondary-transfer roller 23 when recording medium 80 and the primary-transfer toner images on intermediate transfer belt 12 arrive at the secondary-transfer nip.

In this embodiment, secondary-transfer voltages Vtr calculated in Step S7 and applied are switched at interval d according to how far recording medium 80 is conveyed. Thus, an optimal secondary-transfer voltage can be determined and applied according to the varying width of recording medium 80.

Advantageous Effects of the Embodiment

According to the first embodiment of the invention described above, even when recording medium 80 is an odd-shaped medium with a varying width in the direction orthogonal to the medium conveyance direction, optimal secondary-transfer voltages can be applied according to the varying width of recording medium 80. This allows for a reduction in transfer failures (such as image fading or toner scattering), and therefore provides an improvement in image quality.

Since the width of recording medium 80 is detected based on a current flowing through the secondary-transfer device, the width of recording medium 80 can be accurately calculated. This also eliminates the need to input information on the varying width of recording medium 80.

Second Embodiment

Next, a second embodiment of the invention is described. An image formation apparatus according to the second embodiment has, in addition to the functions of the image formation apparatus according to the first embodiment, a function to correct secondary-transfer voltages based on the resistance value of recording medium 80.

Figure 16:
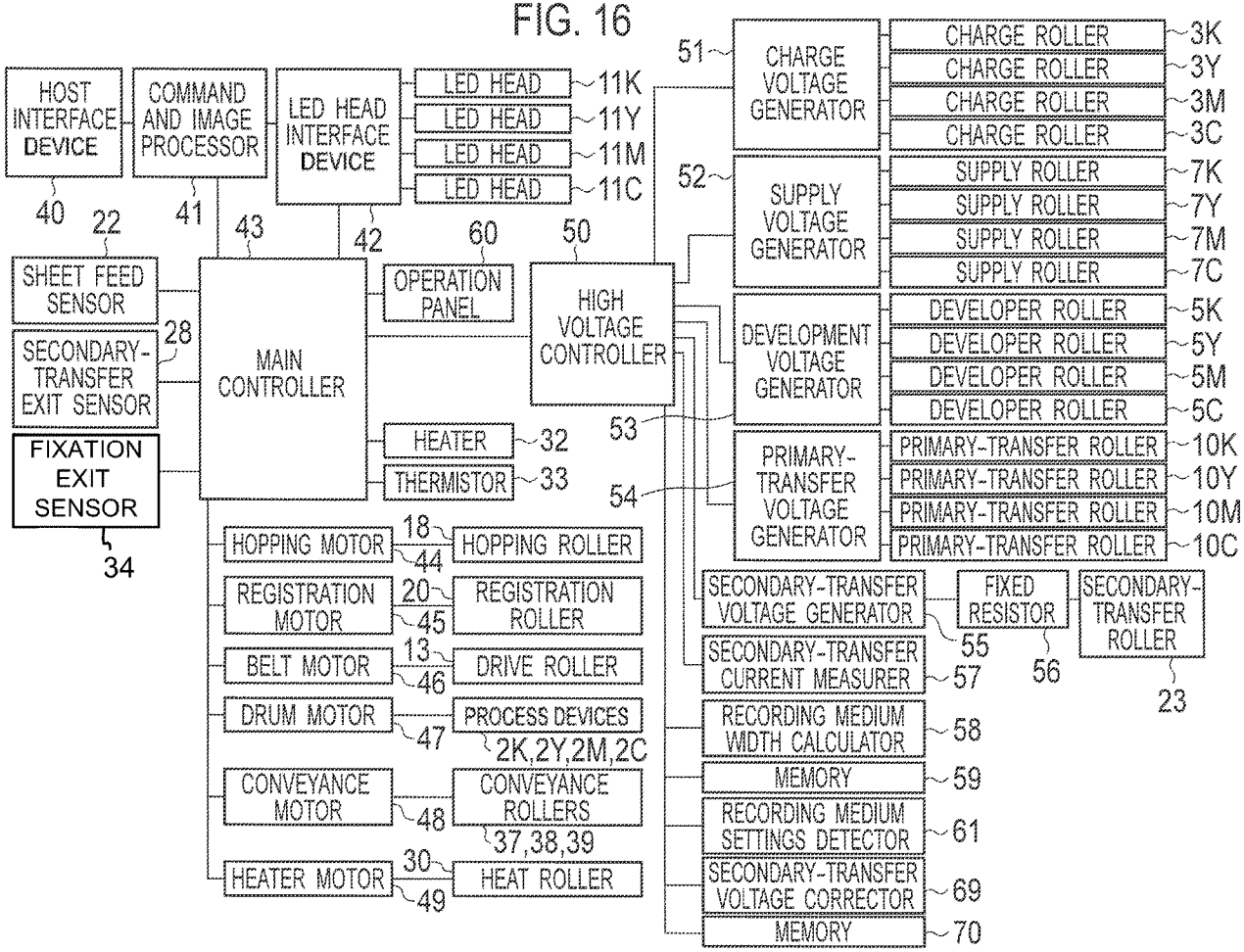
FIG. 16 is a block diagram illustrating a control system of an image formation apparatus of a second embodiment.

FIG. 16 is a block diagram illustrating a control system of the image formation apparatus according to the second embodiment. Constituents of the control system common to the image formation apparatus in FIG. 16 and the image formation apparatus of the first embodiment are denoted by the same reference numerals.

The image formation apparatus of the second embodiment includes the control system of the image formation apparatus of the first embodiment as well as secondary-transfer voltage corrector 69 and memory 70. Secondary-transfer voltage corrector 69 corrects secondary-transfer favorable current density Jb and secondary-transfer favorable voltage Vb (FIG. 13) stored in memory 59, based on measurement results obtained by secondary-transfer current measurer 57. Memory 70 has stored therein corrected secondary-transfer favorable current density Jb' and corrected secondary-transfer favorable voltage Vb' obtained by secondary-transfer voltage corrector 69. Other configurations are the same as those of the image formation apparatus of the first embodiment.

Figure 17:
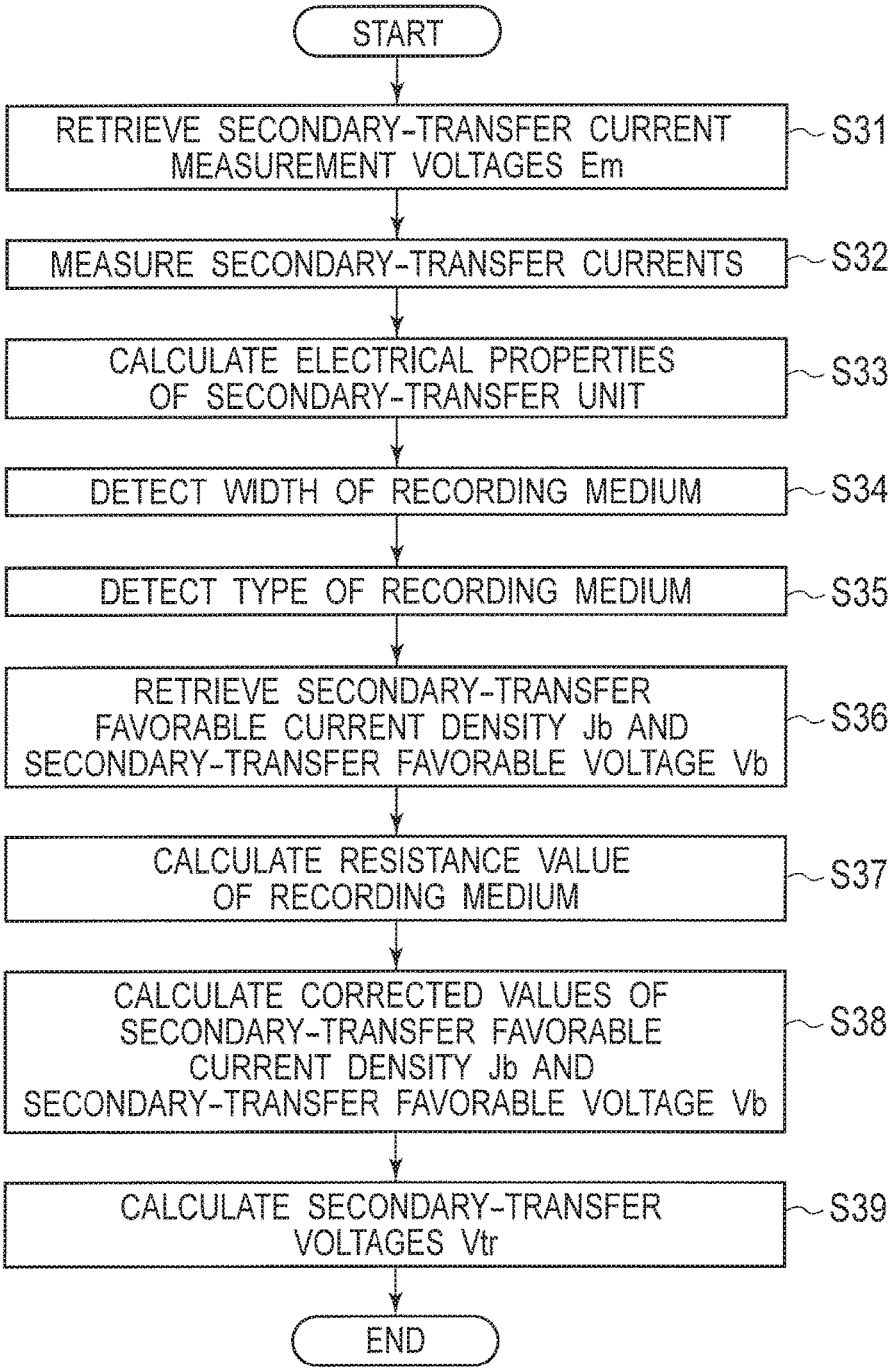
FIG. 17 is a flowchart illustrating a process of calculating secondary-transfer voltages in the second embodiment.

Next, a description is given of a method of calculating the secondary-transfer voltages Vtr in the second embodiment. FIG. 17 is a flowchart illustrating a process of calculating secondary-transfer voltages Vtr. High voltage controller 50 starts a calculation of secondary-transfer voltages Vtr when main controller 43 of the image formation apparatus receives image data from the host computer.

Steps S31 to S36 are the same as Steps S1 to S6 described earlier. Specifically, recording medium width calculator 58 retrieves secondary-transfer current measurement voltages Em1 and Em2 stored in memory 59 (Step S31), and high voltage controller 50 causes secondary-transfer voltage generator 55 to apply the thus-retrieved secondary-transfer current measurement voltages Em1 and Em2 sequentially to secondary-transfer roller 23 and causes secondary-transfer current measurer 57 to measure secondary-transfer currents Im1 and Im2 flowing through secondary-transfer roller 23 (Step S32). Based on the measurement results obtained in Step S32, high voltage controller 50 calculates electrical properties of the secondary-transfer device (the values of coefficients a and b) (Step S33).

High voltage controller 50 retrieves, from memory 59, information on width W of recording medium 80 calculated by recording medium width calculator 58 (Step S34), and causes recording medium settings detector 61 to retrieve information on the type of recording medium 80 (Step S35). Based on the type of recording medium 80 thus retrieved, high voltage controller 50 retrieves secondary-transfer favorable current density Jb and secondary-transfer favorable voltage Vb stored in memory 59 (Step S36).

Next, secondary-transfer voltage corrector 69 calculates the resistance value of recording medium 80 based on second secondary-transfer current table 65 (FIG. 10) created in the process (Step S26) of calculating width W of recording medium 80 (Step S37).

Figures 18, 19:
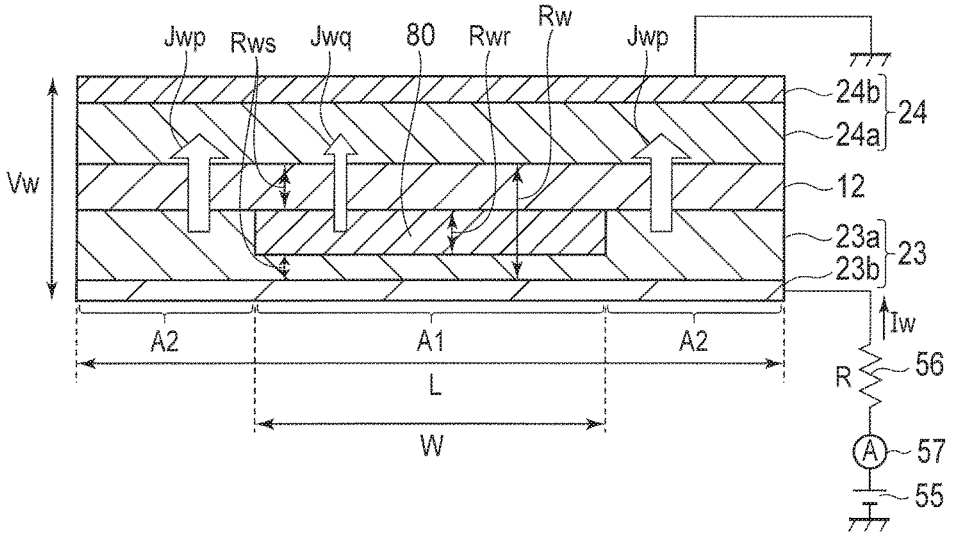
FIG. 18 is a schematic diagram illustrating a secondary-transfer nip in the image formation apparatus of the second embodiment.
FIG. 19 is a diagram illustrating a correction table stored in a memory in the second embodiment.

FIG. 18 is a schematic diagram of the secondary-transfer nip illustrating how the resistance value of recording medium 80 is calculated. First, secondary-transfer voltage corrector 69 selects the smallest secondary-transfer current Iw value ($Iw_{ref}$) in second secondary-transfer current table 65 (FIG. 10). Assume here that secondary-transfer current Iw at measurement position 50*d* is the smallest value.

Using this secondary-transfer current $Iw_{ref}$ and Formulae (9) to (14) described in the first embodiment, resistance value Rw of recording medium 80 per unit length ($Rw=Vw_{ref}/Jwq_{ref}$) is found.

When the resistance value of recording medium 80 is Rwr (MΩ) and the resistance value of recording medium area A1 excluding recording medium 80 is Rws (MΩ), resistance value Rws of recording medium area A1 excluding recording medium 80 is found by the following Formula (25) using secondary-transfer current density $Jwp_{ref}$ found by Formula (10) and secondary-transfer inter-shaft voltage $Vw_{ref}$ found by Formula (9):

$$Rws=Vw_{ref}/Jwp_{ref}. \tag{25}$$

Resistance value Rwr of recording medium 80 is calculated by dividing resistance value Rw per unit length of recording medium 80 by resistance value Rws of recording medium area A1 excluding recording medium 80, and is therefore found by the following Formula (26):

$$Rwr=Rw-Rws. \tag{26}$$

Secondary-transfer voltage corrector 69 calculates resistance value Rt of a reference recording medium using secondary-transfer favorable current density Jb and secondary-transfer favorable voltage Vb retrieved in Step S36 from secondary-transfer favorable current density and voltage table 67 (FIG. 13) in memory 59 and the following Formula (27):

$$Rt=Vb1/Jb1. \tag{27}$$

A reference recording medium is a recording medium used in the experiment for creating secondary-transfer favorable current density and voltage table 67 (FIG. 13). Resistance value Rt (MΩ) of the reference recording medium calculated here is for a case where the type of recording medium 80 retrieved by recording medium settings detector 61 in Step S35 is "plain paper".

Based on the ratio of resistance value Rwr of recording medium 80 calculated in Step S37 to resistance value Rt of the reference recoding medium, secondary-transfer voltage corrector 69 calculates corrected secondary-transfer favorable current density Jb' and corrected secondary-transfer favorable voltage Vb' (Step S38).

Specifically, ratio A of resistance value Rwr of recording medium 80 found by Formula (26) to resistance value Rt of the reference recoding medium is expressed by the following formula (28):

$$A=Rwr/Rt. \tag{28}$$

It has been experimentally demonstrated that secondary-transfer favorable current density Jb necessary for the secondary transfer of toner images on intermediate transfer belt 12 onto recording medium 80 is not affected much by the resistance value of recording medium 80, but secondary-transfer favorable voltage Vb increases as the resistance value of recording medium 80 increases.

Thus, in the second embodiment, secondary-transfer favorable voltage Vb in secondary-transfer favorable current density and voltage table 67 (FIG. 13) is corrected by being multiplied by ratio A of resistance value Rwr of recording medium 80 to resistance value Rt of the reference recoding medium found by Formula (28).

Thus, corrected secondary-transfer favorable current density Jb' and corrected secondary-transfer favorable voltage Vb' are found respectively by the following Formulae (29) and (30):

$$Jb'=Jb, \text{ and} \tag{29}$$

$$Vb'=Vb\times A. \tag{30}$$

Secondary-transfer voltage corrector 69 stores the thus-calculated secondary-transfer favorable current density Jb' and secondary-transfer favorable voltage Vb' in memory 70 as correction table 71. FIG. 19 is a diagram illustrating an example of correction table 71 for secondary-transfer favorable current density Jb' and secondary-transfer favorable voltage Vb'.

Correction table 71 in FIG. 19 has stored therein corrected secondary-transfer favorable current density Jb' and corrected secondary-transfer favorable voltage Vb' for each of the types of recording medium 80 (which are, here, plain paper, heavy paper, and film paper).

High voltage controller 50 calculates secondary-transfer voltages Vtr based on the electrical properties of the secondary-transfer device obtained in Step S33, widths W of recording medium 80 obtained in Step S34, and secondary-transfer favorable current density Jb' and secondary-transfer favorable voltage Vb' calculated in Step S38 (Step S39). Step S39 is the same as Step S7 in the first embodiment, except that Step S39 uses corrected secondary-transfer favorable current density Jb' and corrected secondary-transfer favorable voltage Vb'.

According to the second embodiment of the invention described above, optimal secondary-transfer voltages can be applied to recording medium 80 according to not only the varying width of recording medium 80 in the direction orthogonal to the medium conveyance direction, but also the resistance value of recording medium 80.

Third Embodiment

Next, a third embodiment of the invention is described. In the first and second embodiments, the width of a recording medium is detected based on a current flowing through the secondary-transfer device. In the third embodiment, information on the width of a recording medium is acquired from print data sent from an external device (a host computer).

Figure 20:
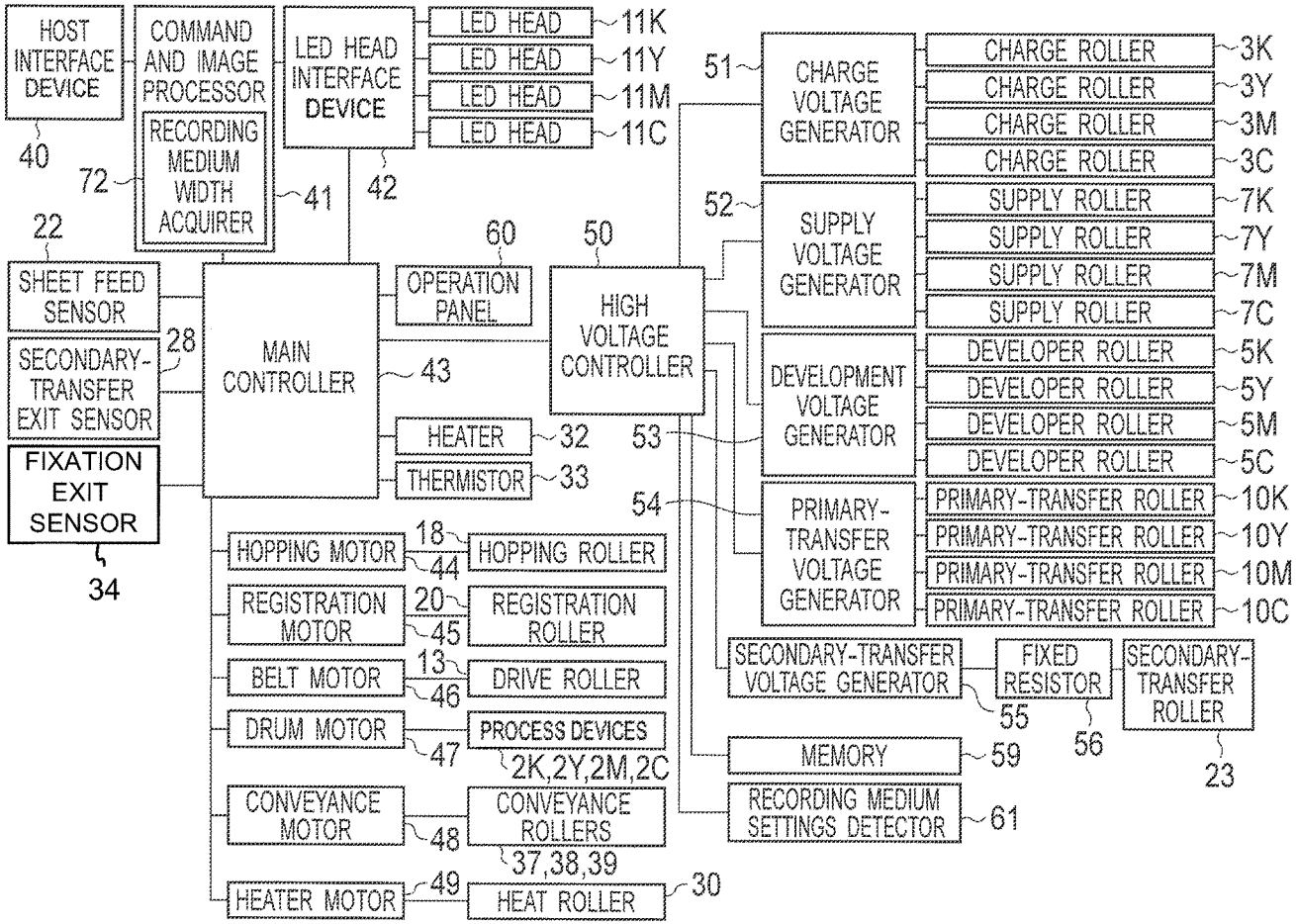
FIG. 20 is a block diagram illustrating a control system of an image formation apparatus of a third embodiment.

FIG. 20 is a block diagram illustrating a control system of an image formation apparatus according to the third embodiment. Constituents of the control system common to the image formation apparatus in FIG. 20 and the image formation apparatus of the first embodiment are denoted by the same reference numerals.

The control system of the image formation apparatus of the third embodiment does not include secondary-transfer current measurer 57 and recording medium width calculator 58 of the constituents of the control system described in the first embodiment (FIG. 3), and instead, includes recording medium width acquirer 72 within command and image processor 41. Recording medium width acquirer 72 acquires information indicating the shape of recording medium 90 from print data sent from the host computer (external device), and calculates the width of recording medium 90 based on the information.

Figure 21A:
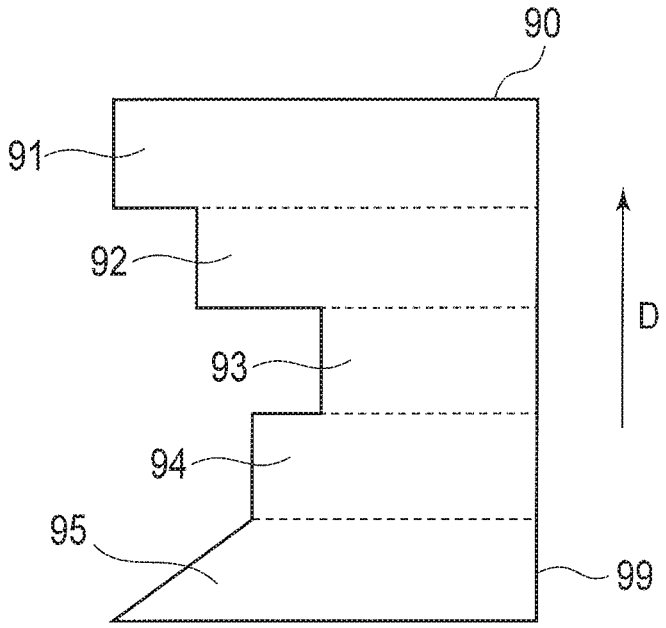
FIG. 21A is a schematic diagram illustrating the shape of a recording medium in the third embodiment.

FIG. 21A is a schematic diagram illustrating an example of the shape of recording medium 90. Recording medium 90 is an odd-shaped medium of a varying width in a direction orthogonal to the medium conveyance direction (indicated by arrow D). In this example, recording medium 90 has five strip portions 91 to 95 of different widths arranged at equal intervals in the medium conveyance direction.

Figure 21B:
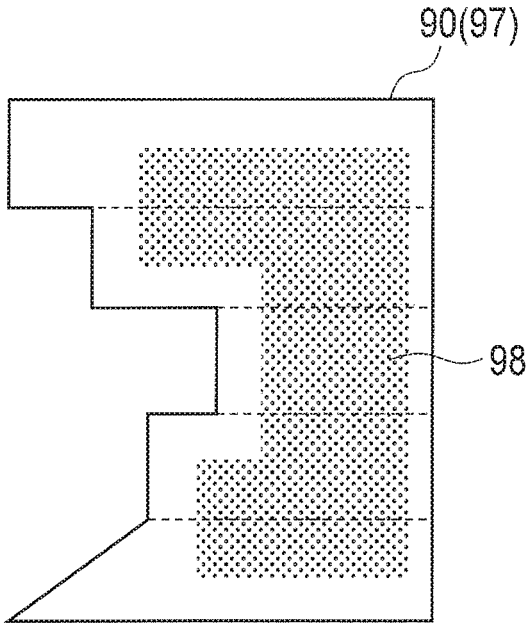
FIG. 21B is a schematic diagram illustrating print data in the third embodiment.

FIG. 21B is a schematic diagram illustrating image data 98 and information 97 contained in print data, information 97 indicating the shape of recording medium 90. As illustrated in FIG. 21B, the print data contains image data 98 and information 97 indicating the shape (contours) of recording medium 90.

Information 97 indicating the shape of recording medium 90 is generated, for example, such that a user, in generating image data 98 on the host computer by using an application program for creating images, draws a line describing the shape of recording medium 90 on a separate layer from the image.

Information 97 indicating the shape of recording medium 90 is sent from the host computer to the image formation apparatus as print data along with image data 98. Image data 98 is converted into bitmap data by command and image processor 41. Recording medium width acquirer 72 extracts information 97 indicating the shape of recording medium 90, and calculates the width of recording medium 90 based on information 97 thus extracted.

Although recording medium width acquirer 72 is provided within command and image processor 41 in the example illustrated in FIG. 20, a printer driver, for example, may extract the information on the shape of recording medium 90 from the print data sent from the host computer.

Next, control of secondary-transfer voltages according to the third embodiment is described. As described above, recording medium width acquirer 72 calculates the widths of recording medium 90 based on the print data. Based on the widths of recording medium 90 calculated by recording medium width acquirer 72, high voltage controller 50 changes secondary-transfer voltages according to how far recording medium 90 is conveyed.

Figure 22B:
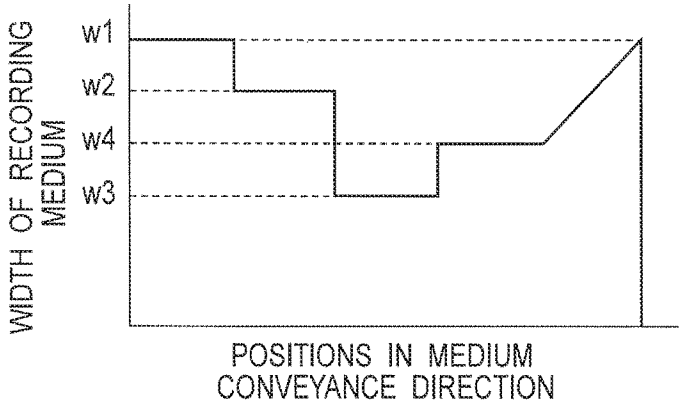
FIGS. 22A, 22B, and 22C are diagrams illustrating, respectively, the shape of a recording medium, the widths of the recording medium, and secondary-transfer voltages in the third embodiment.
Figure 22C:
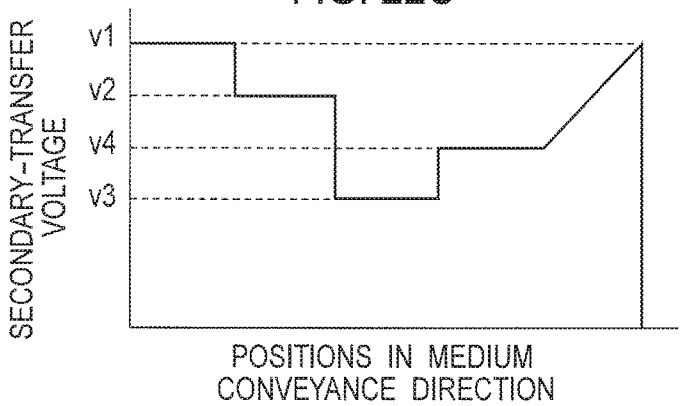
Figure 22A:
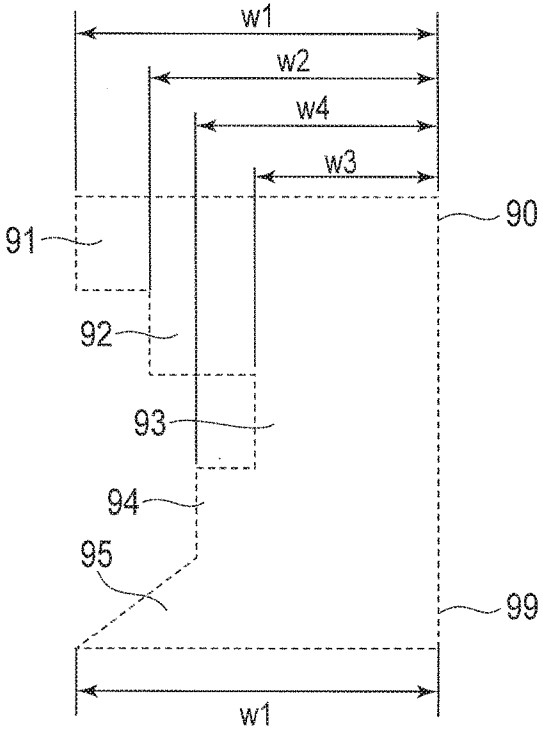

FIG. 22A is a diagram illustrating the shape of recording medium 90. As mentioned earlier, recording medium 90 has five strip portions 91 to 95 at equal intervals in the medium conveyance direction. One ends 99 of respective strip portions 91 to 95 in the direction orthogonal to the medium conveyance direction (right ends in FIG. 22A) are aligned, while their other ends are located at different positions.

Out of strip portions 91 to 95 constituting recording medium 90, four strip portions 91, 92, 93, and 94 are rectangles whose widths in the direction orthogonal to the medium conveyance direction are W1, W2, W3, and W4, respectively. Width W1 is the largest of widths W1 to W4.

Out of strip portions 91 to 95 constituting recording medium 90, strip portion 95 located at the tailing edge in the medium conveyance direction has a slanted end on the opposite side from its one end 99. Strip portion 95 has the maximum width at the tailing edge in the medium conveyance direction, and this maximum width is the same as width W1.

FIG. 22B is a diagram illustrating the varying width of recording medium 90 calculated by recording medium width acquirer 72. Based on the shape of recording medium 90 acquired, recording medium width acquirer 72 calculates the width of recording medium 90 at each position in the medium conveyance direction as illustrated in FIG. 22B. In this example, at certain positions in the medium conveyance direction, the width of recording medium 90 changes stepwise from W1 to W2, W2 to W3, and W3 to W4, and then increases linearly from W4 to W1.

FIG. 22C is a schematic diagram illustrating a method of controlling the secondary-transfer voltages. Based on the varying width of recording medium 90 calculated by recording medium width acquirer 72, high voltage controller 50 changes the secondary-transfer voltage stepwise from V1 to V2, V2 to V3, and V3 to V4 and increases the secondary-transfer voltage linearly from V4 to V1, at the corresponding positions in the medium conveyance direction.

Secondary-transfer voltages V1, V2, V3, and V4 are secondary-transfer voltages Vtr calculated based respectively on widths W1, W2, W3, and W4 of recording medium 90 using Formulae (19) to (24) described in the first embodiment.

Thus, optimal secondary-transfer voltages can be determined and applied according to the varying width of recording medium 90, which enables an improvement in image quality.

Next, a description is given of a second example of the method of controlling secondary-transfer voltages. FIG. 23A is a diagram illustrating the shape of recording medium 90. In this second example, recording medium 90 is divided into five sections 101 to 105 arranged in the medium conveyance direction, and if the width of recording medium 90 varies within any of the sections, the varying width of recording medium 90 in the section is approximated by the maximum width within the section.

For example, in section 105, the width of recording medium 90 changes from W4 to W1. In the second example, width W1, which is the maximum width within section 105, is set as width W5 for section 105.

Figure 23B:
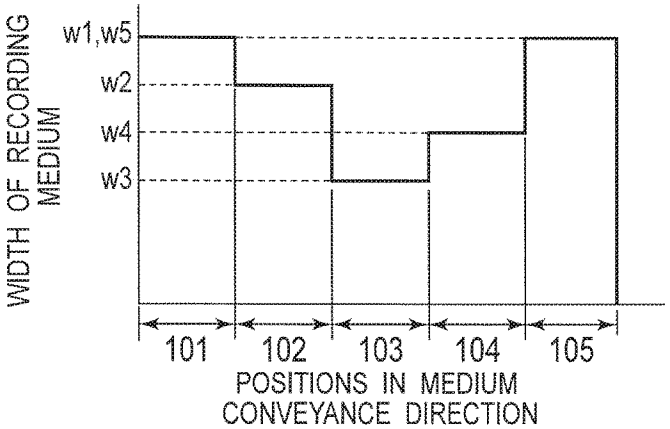
FIGS. 23A, 23B, and 23C are diagrams illustrating, respectively, the shape of a recording medium, the widths of the recording medium, and secondary-transfer voltages in the third embodiment.

FIG. 23B is a diagram illustrating the varying width of recording medium 90 calculated by recording medium width acquirer 72. Recording medium width acquirer 72 calculates the width of recording medium 90 for each of sections 101 to 105 as illustrated in FIG. 23B. In this example, width W1 being the maximum width within section 105 is set as width W5 for section 105. Thus, the width of recording medium 90 changes stepwise from W1 to W2, W2 to W3, W3 to W4, and W4 to W5 (=W1).

Figure 23C:
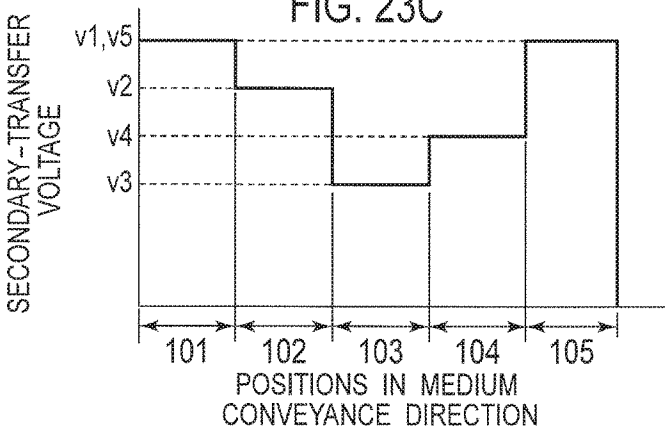
Figure 23A:
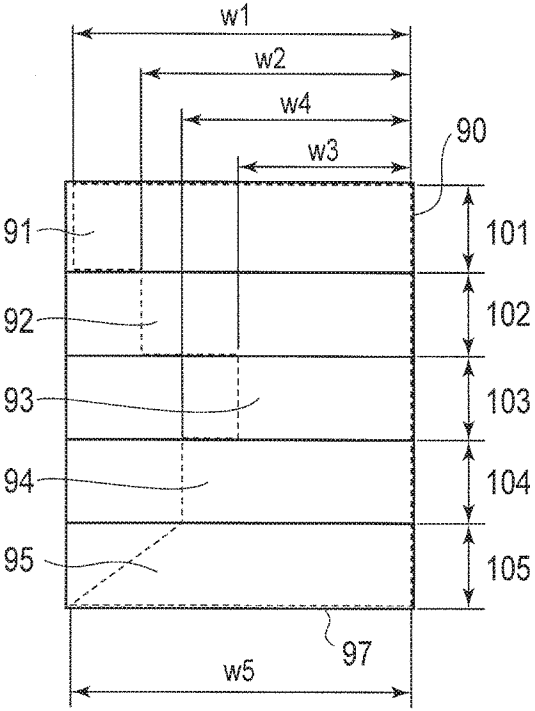

FIG. 23C is a schematic diagram illustrating a method of controlling secondary-transfer voltages. Based on the varying width of recording medium 90 calculated by recording medium width acquirer 72, high voltage controller 50 changes the secondary-transfer voltage stepwise from V1 to V2, V2 to V3, V3 to V4, and V4 to V5 for the respective sections 101 to 105. Secondary-transfer voltage V5 is the same as secondary-transfer voltage V1.

Figure 24A:
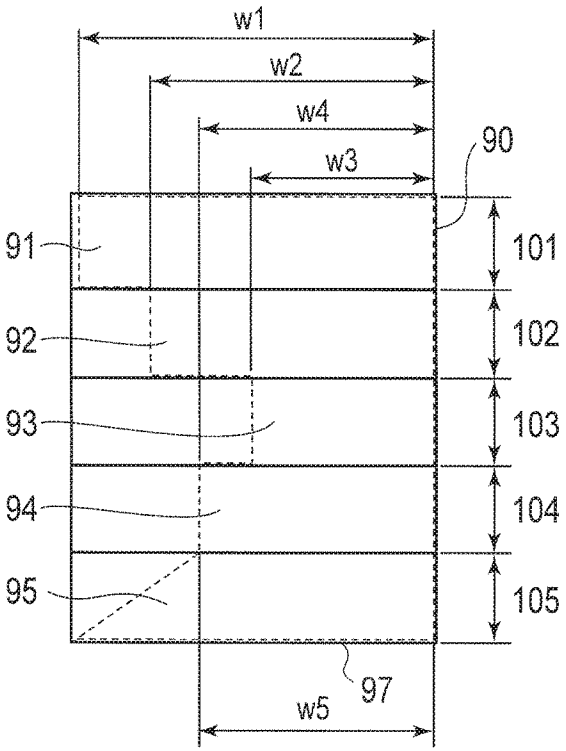
FIGS. 24A, 24B, and 24C are diagrams illustrating, respectively, the shape of a recording medium, the widths of the recording medium, and secondary-transfer voltages in the third embodiment.

Next, a description is given of a third example of the method of controlling secondary-transfer voltages. FIG. 24A is a diagram illustrating the shape of recording medium 90. In this third example, recording medium 90 is divided into five sections 101 to 105 arranged in the medium conveyance direction, and if the width of recording medium 90 varies within any of the sections, the varying width of recording medium 90 in the section is approximated by the minimum width within the section.

For example, in section 105, the width of recording medium 90 changes from W4 to W1. In the third example, width W4, which is the minimum width within section 105, is set as width W5 for section 105.

Figure 24B:
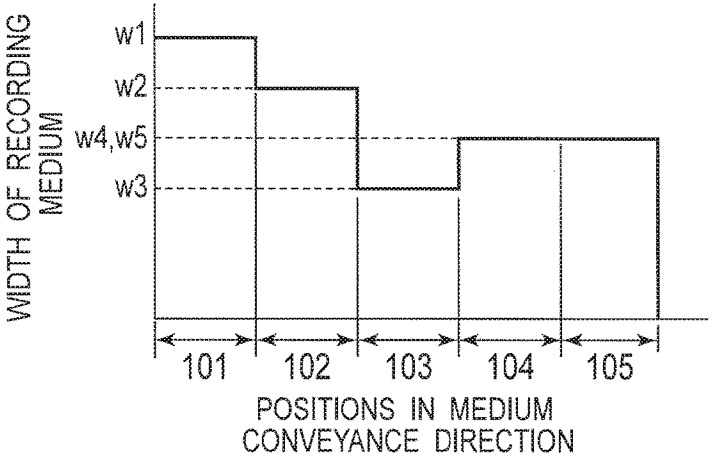

FIG. 24B is a diagram illustrating the varying width of recording medium 90 calculated by recording medium width acquirer 72. Recording medium width acquirer 72 calculates the width of recording medium 90 for each of sections 101 to 105 as illustrated in FIG. 24B. In this example, width W4 being the minimum width within section 105 is set as width W5 for section 105. Thus, the width of recording medium 90 changes stepwise from W1 to W2, W2 to W3, W3 to W4, and W4 to W5 (=W4).

Figure 24C:
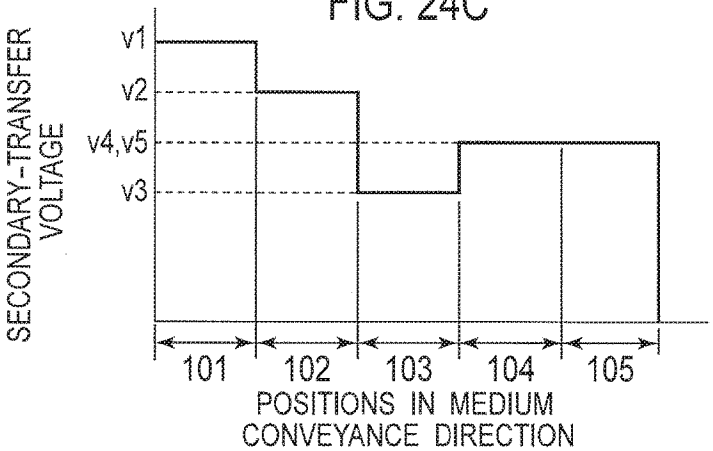

FIG. 24C is a schematic diagram illustrating a method of controlling the secondary-transfer voltages. Based on the varying width of recording medium 90 calculated by recording medium width acquirer 72, high voltage controller 50 changes the secondary-transfer voltage stepwise from V1 to V2, V2 to V3, V3 to V4, and V4 to V5 for the respective sections 101 to 105. Secondary-transfer voltage V5 is the same as secondary-transfer voltage V4.

Next, a description is given of a fourth example of the method of controlling secondary-transfer voltages. FIG. 25A is a diagram illustrating the shape of recording medium 90. In this fourth example, recording medium 90 is divided into five sections 101 to 105 in the medium conveyance direction, and if the width of recording medium 90 varies within any of the sections, the varying width of recording medium 90 in the section is approximated by the average of the widths within the section.

For example, in section 105, the width of recording medium 90 changes from W4 to W1. In the fourth example, the average width within section 105, that is, (W4+W1)/2 is set as width W5 for section 105.

Figure 25B:
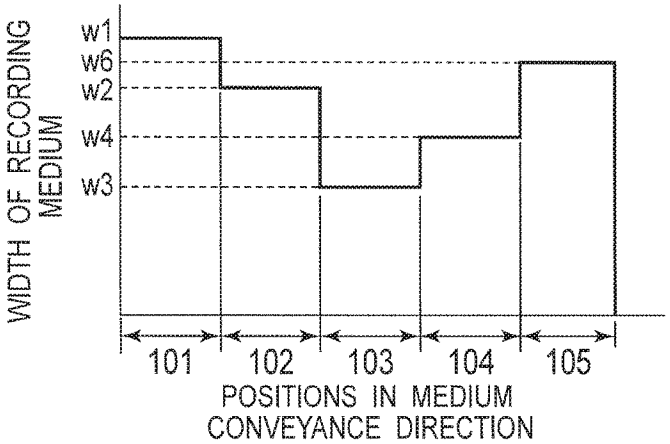
FIGS. 25A, 25B, and 25C are diagrams illustrating, respectively, the shape of a recording medium, the widths of the recording medium, and secondary-transfer voltages in the third embodiment.

FIG. 25B is a diagram illustrating the varying width of recording medium 90 calculated by recording medium width acquirer 72. Recording medium width acquirer 72 calculates the width of recording medium 90 for each of sections 101 to 105 as illustrated in FIG. 25B. In this example, the average width in section 105, that is, (W4+W1)/2 is set as width W5 for section 105. Thus, the width of recording medium 90 changes stepwise from W1 to W2, W2 to W3, W3 to W4, and W4 to W5.

Figure 25C:
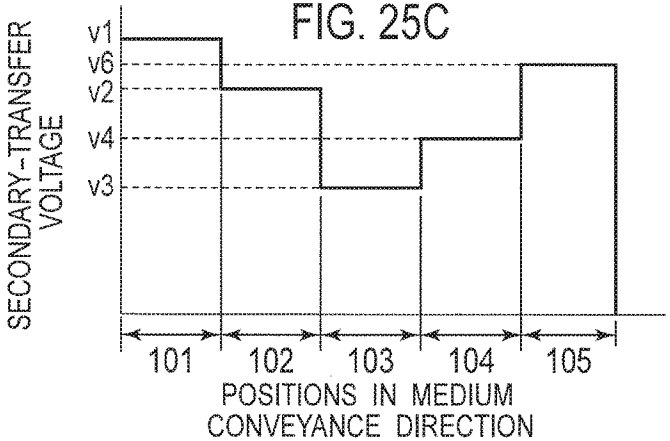
Figure 25A:
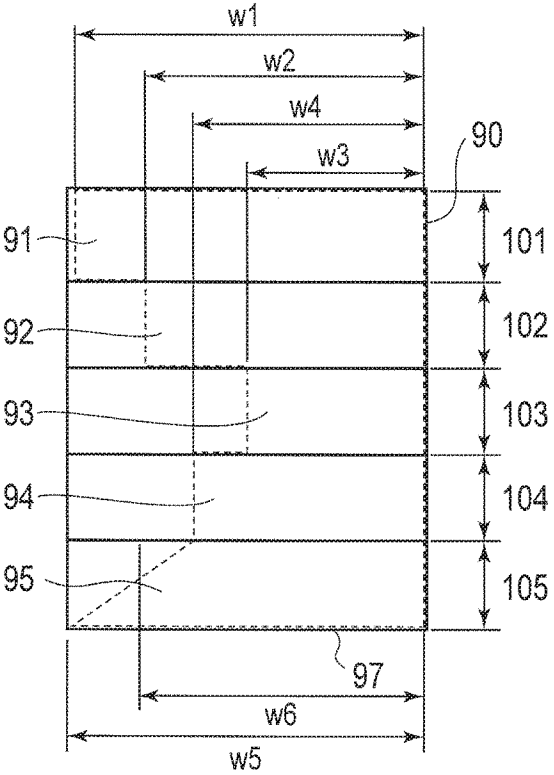

FIG. 25C is a schematic diagram illustrating a method of controlling the secondary-transfer voltages. Based on the varying width of recording medium 90 calculated by recording medium width acquirer 72, high voltage controller 50 changes the secondary-transfer voltage stepwise from V1 to V2, V2 to V3, V3 to V4, and V4 to V5 for the respective sections 101 to 105.

According to the second to fourth examples of the method of controlling secondary-transfer voltages (FIGS. 23A to 25C), a certain approximation is used for a section in which the width of recording medium 90 changes. This allows for a simplification of the information on the varying width of recording medium 90 and an improvement in the processing speed.

According to the third embodiment of the invention described above, information indicating the shape of recording medium 90 is acquired from print data sent from an external device (a host computer), and secondary-transfer voltages are calculated based on the widths of recording medium 90 calculated based on the information thus acquired. Thus, secondary-transfer voltages applied are optimally determined according to the varying width of recording medium 90, which enables an improvement in the image quality.

In the embodiments described above, recording medium 80 and recording medium 90 shaped as illustrated in FIG. 9 and FIG. 21A are used as examples of a recording medium having a varying width in the direction orthogonal to the medium conveyance direction (an odd-shaped medium). However, the shape of a recording medium is not limited to these shapes.

Figure 26A:
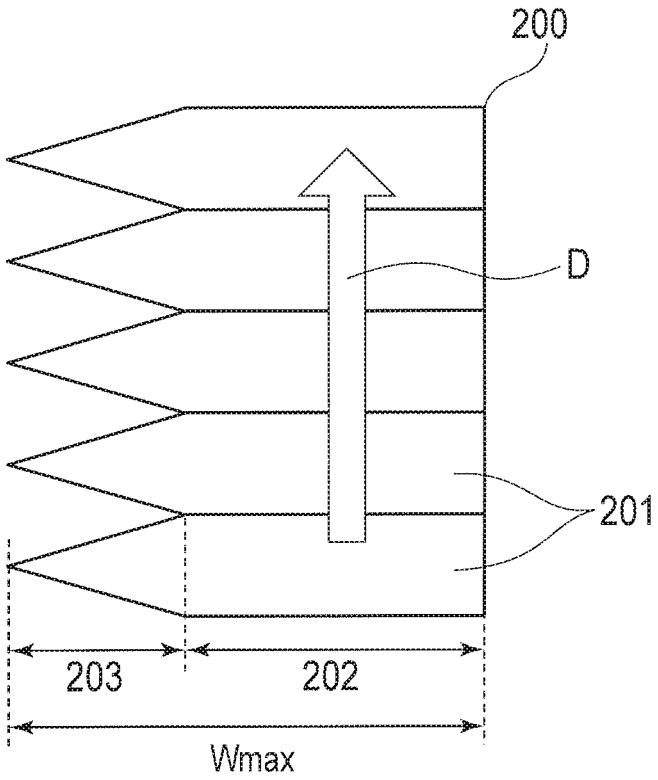
FIGS. 26A and 26B are diagrams illustrating, respectively, another example of the shape of a recording medium and its usage example.

FIG. 26A is a diagram illustrating an example of recording medium 200 having a different shape. In this example, recording medium 200 has five strip portions 201 arranged at equal intervals in the medium conveyance direction (indicated by arrow D).

Each strip portion 201 of recording medium 200 has rectangular portion 202 which is long in the direction orthogonal to the medium conveyance direction and triangular portion 203 formed at one end of rectangular portion 202 in the direction orthogonal to the medium conveyance direction (the left end in FIG. 26A).

Triangular portion 203 is shaped such that its center portion in the medium conveyance direction has the maximum width. In other words, recording medium 200 has a maximum width Wmax at its center portion in the medium conveyance direction of each of strip portions 201.

Even when recording medium 200 of such a shape is used, according to the embodiments described above, optimal secondary-transfer voltages can be determined and applied according to the varying width of recording medium 200 in the direction orthogonal to the medium conveyance direction.

Figure 26B:
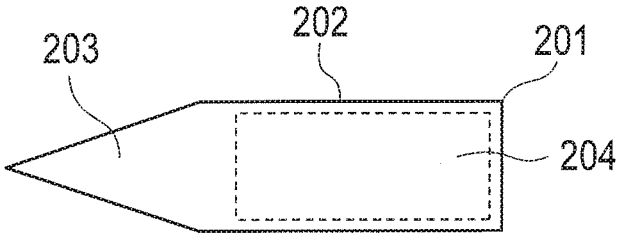

FIG. 26B illustrates strip portion 201 which is one of the individual strip portions 201 into which recording medium 200 illustrated in FIG. 26A is divided after images are formed on recording medium 200. In this example, image 204 is formed on rectangular portion 202 of each strip portion 201 of recording medium 200. A user may hold strip portion 201 with rectangular portion 202, printed with image 204, up and insert triangular portion 203 into, for example, soil in a plant pot. Thereby, strip portion 201 can be used as, for example, a plant marker.

Although a printer is used as an example of the image formation apparatuses in the above-described embodiments, the invention is not limited to printers. The invention is also applicable to other types of image formation apparatuses, such as a copier, a facsimile machine, or a multi-purpose device with capabilities of a printer, a copier, a facsimile machine, and/or the like.

In addition, although LED heads are used to form latent images in the above embodiments, the invention is not limited to LED heads. For example, laser light sources or the like may be used instead.

In addition, although optimal secondary-transfer voltages are determined and applied according to the varying width of a recording medium in the above embodiments, the invention is not limited to this. For example, optimal primary-transfer voltages may be determined and applied according to the varying width of a recording medium. Specifically, an image formation apparatus includes a fixed resistor connected between each of primary-transfer rollers 10K, 10Y, 10M, and 10C and primary-transfer voltage generator 54 and a primary-transfer current measurer that measures a current flowing through the fixed resistor. The image formation apparatus calculates the width of a recording medium based on a current measured, and determines an optimal primary-transfer voltage based on the calculated width.

In addition, although the image formation apparatuses of the above embodiments form images using the intermediate transfer method, the invention may be applied to an image formation apparatus that does not include components such as intermediate transfer belt 12 and forms images using the direct transfer method (tandem printing). Specifically, an image formation apparatus employing the direct transfer method detects the width of a recording medium at a recording medium conveyance roller pair located on conveyance path 15 for the recording medium, upstream of process devices 2K, 2Y, 2M, and 2C. More specifically, the direct-transfer image formation apparatus includes a fixed resistor connected between the recording medium conveyance roller pair and a voltage applier and a current measurer that measures a current flowing through the fixed resistor. The direct-transfer image formation apparatus calculates the width of a recording medium based on the current measured, and calculates an optimal voltage to apply to transfer rollers 10K 10Y, 10M, and 10C of process devices 2K, 2Y, 2M, and 2C based on the calculated width.

In addition, the above embodiments have described the voltage controller, which comprises high voltage controller 50, secondary-transfer current measurer 57, recording medium width calculator 58, and memory 59, as hardware such as a circuit. However, the voltage controller may be realized as software or as a combination of software and hardware.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a process device that forms a developer image;

a transfer device that transfers the developer image formed by the process device onto a recording medium;

a voltage applier that applies a voltage to the transfer device;

a voltage controller that acquires information on a width of the recording medium in a direction orthogonal to a medium conveyance direction, and controls the voltage applied by the voltage applier to the transfer device based on the width of the recording medium; and a current measurer that measures a current that flows through the transfer device for each of sections of the recording medium in the medium conveyance direction when the voltage applier applies a voltage to the transfer device, wherein:

the information on the width of the recording medium is acquired from the current measurer, and the voltage controller controls the voltage applied to the transfer device based on the current that flows through the transfer device measured by the current measurer.

2. The image formation apparatus according to claim 1, further comprising a recording medium width detector that detects the width of the recording medium, wherein the voltage controller controls the voltage applied by the voltage applier to the transfer device based on the width of the recording medium detected by the recording medium width detector.

3. The image formation apparatus according to claim 2, wherein the recording medium width detector includes the current measurer, and a recording medium width calculator that calculates the width of the recording medium based on the current that flows through the transfer device and is measured by the current measurer.

4. The image formation apparatus according to claim 3, wherein the current measurer measures a first current that flows through the transfer device when the voltage applier applies a voltage to the transfer device with the recording medium not passing through the transfer device, and measures a second current that flows through the transfer device when the voltage applier applies a voltage to the transfer device with the recording medium passing through the transfer device.

5. The image formation apparatus according to claim 4, wherein the recording medium width calculator calculates the width of the recording medium based on the first current and the second current measured by the current measurer.

6. The image formation apparatus according to claim 3, wherein the recording medium width calculator calculates a resistance value of the recording medium based on the current that flows through the transfer device and is measured by the current measurer, and the voltage controller controls the voltage applied by the voltage applier to the transfer device based on the resistance value of the recording medium and a reference resistance value.

7. The image formation apparatus according to claim 2, wherein the recording medium width detector detects the width of the recording medium before printing operation starts.

8. The image formation apparatus according to claim 1, wherein the transfer device includes a primary-transfer device that performs a primary transfer process to transfer the developer image formed by the process device onto an intermediate transfer body, and a secondary-transfer device that performs a secondary transfer process to transfer the developer image on the intermediate transfer body onto the recording medium, the voltage applier applies a voltage to the secondary-transfer device, and the voltage controller controls the voltage applied by the voltage applier to the secondary-transfer device based on the width of the recording medium.

9. The image formation apparatus according to claim 8, further comprising a recording medium width detector that detects the width of the recording medium, wherein the voltage controller controls the voltage applied by the voltage applier to the secondary-transfer device based on the width of the recording medium detected by the recording medium width detector.

10. The image formation apparatus according to claim 9, wherein the recording medium width detector includes a current measurer that measures a current that flows through the secondary-transfer device when the voltage applier applies a voltage to the secondary-transfer device, and a recording medium width calculator that calculates the width of the recording medium based the current that flows through the secondary-transfer device and is measured by the current measurer.

11. The image formation apparatus according to claim 10, wherein the current measurer measures a first current that flows through the secondary-transfer device when the voltage applier applies a voltage to the secondary-transfer device with the recording medium not passing through the secondary-transfer device and a second current that flows through the secondary-transfer device when the voltage applier applies a voltage to the secondary-transfer device with the recording medium passing through the secondary-transfer device.

12. The image formation apparatus according to claim 11, wherein the recording medium width calculator calculates the width of the recording medium based on the first current and the second current measured by the current measurer.

13. The image formation apparatus according to claim 10, wherein the recording medium width calculator calculates a resistance value of the recording medium based on the current that flows through the secondary-transfer device and is measured by the current measurer, and the voltage controller controls the voltage applied by the voltage applier to the secondary-transfer device based on the resistance value of the recording medium and a reference resistance value.

14. The image formation apparatus according to claim 1, wherein the transfer device includes a primary-transfer device that performs a primary transfer process to transfer the developer image formed by the process device onto an intermediate transfer body, and a secondary-transfer device that performs a secondary transfer process to transfer the developer image on the intermediate transfer body onto the recording medium, the voltage applier includes a first voltage applier that applies a voltage to the primary-transfer device, and a second voltage applier that applies a voltage to the secondary-transfer device, and based on the width of the recording medium, the voltage controller controls the voltage applied by the first voltage applier to the primary-transfer device and the voltage applied by the second voltage applier to the secondary-transfer device.

15. An image formation apparatus comprising:

a process device that forms a developer image;

a transfer device that transfers the developer image formed by the process device onto a recording medium;

a voltage applier that applies a voltage to the transfer device; and a voltage controller that acquires information on a width of the recording medium in a direction orthogonal to a medium conveyance direction, and controls the voltage applied by the voltage applier to the transfer device based on the width of the recording medium, wherein:

the information on the width of the recording medium is acquired from print data received from an external device, the information on the width of the recording medium includes width correspondence information corresponding to each section in the medium conveyance direction, the voltage controller controls the voltage applied to the transfer device based on the information on the width of the recording medium acquired from the print data.

16. The image formation apparatus according to claim 15, wherein a recording medium width acquirer determines the width of the recording medium for each of sections of the recording medium in the medium conveyance direction.

17. The image formation apparatus according to claim 16, wherein the width of the recording medium for each of the sections is approximated by a maximum value of the width of the recording medium within the section.

18. The image formation apparatus according to claim 16, wherein the width of the recording medium for each of the sections is approximated by a minimum value of the width of the recording medium within the section.

19. The image formation apparatus according to claim 16, wherein the width of the recording medium for each of the sections is approximated by an average value of a maximum value and a minimum value of the width of the recording medium within the section.

* * * * *